US008567630B2

(12) United States Patent
Yang et al.

(10) Patent No.: US 8,567,630 B2
(45) Date of Patent: Oct. 29, 2013

(54) RECEPTACLE WITH MOTION DAMPERS FOR LID AND AIR FILTRATION DEVICE

(71) Applicant: simplehuman, LLC, Torrance, CA (US)

(72) Inventors: Frank Yang, Rancho Palos Verdes, CA (US); Joseph Sandor, Santa Ana Heights, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 13/801,140

(22) Filed: Mar. 13, 2013

(65) Prior Publication Data

US 2013/0193145 A1 Aug. 1, 2013

Related U.S. Application Data

(63) Continuation of application No. 12/399,828, filed on Mar. 6, 2009, now Pat. No. 8,418,869.

(51) Int. Cl.
*B65D 43/26* (2006.01)

(52) U.S. Cl.
USPC ..... 220/264; 220/827; 220/908.1; 220/908.2

(58) Field of Classification Search
USPC ..... 220/260, 262–264, 495.01, 495.04, 220/495.06, 827, 838, 908, 908.1, 908.2
See application file for complete search history.

(56) References Cited

U.S. PATENT DOCUMENTS

| | | | |
|---|---|---|---|
| 1,426,211 | A | 8/1922 | Pausin |
| 1,461,253 | A | 7/1923 | Owen |
| 1,754,802 | A | 4/1930 | Raster |
| 1,820,555 | A | 8/1931 | Buschman |
| 1,891,651 | A | 12/1932 | Padelford et al. |
| 1,922,729 | A | 8/1933 | Giebel |
| 1,980,938 | A | 11/1934 | Geibel |
| D148,825 | S | 2/1948 | Snider |
| 2,457,274 | A | 12/1948 | Rifken |
| 2,759,625 | A | 8/1956 | Ritter |
| 2,888,307 | A | 5/1959 | Graves et al. |

(Continued)

FOREIGN PATENT DOCUMENTS

| | | |
|---|---|---|
| AU | 622536 | 4/1992 |
| CA | 2519295 | 3/2007 |

(Continued)

OTHER PUBLICATIONS

U.S. Appl. No. 13/417,084, filed Jan. 20, 2012, Yang et al.

(Continued)

*Primary Examiner* — J. Gregory Pickett
*Assistant Examiner* — Ned A Walker
(74) *Attorney, Agent, or Firm* — Knobbe Martens Olson & Bear LLP

(57) ABSTRACT

A receptacle having a lid which has a pair of dampers configured to slow the movement of the lid from an open position toward a closed position. The dampers are provided at opposite ends of a pedal connected to the receptacle body at opposite lateral positions relative to a side of the receptacle body. The receptacle includes an air filtration device mounted in its lid which guides air through the filter device during the downward motion of the lid. The receptacle also includes at least one damper which provides dampening forces against the motion of the lid in both opening and closing directions. The receptacle also includes an anti-sliding device which increases the receptacle's resistance to sliding across a floor when a user steps on a pedal to actuate the lid.

9 Claims, 14 Drawing Sheets

(56) References Cited

U.S. PATENT DOCUMENTS

| | | | |
|---|---|---|---|
| 2,946,474 | A | 7/1960 | Knapp |
| 3,008,604 | A | 11/1961 | Garner |
| 3,023,922 | A | 3/1962 | Arrington et al. |
| 3,137,408 | A | 6/1964 | Taylor |
| 3,654,534 | A | 4/1972 | Fischer |
| 3,820,200 | A | 6/1974 | Myers |
| 3,825,150 | A | 7/1974 | Taylor |
| 3,825,215 | A | 7/1974 | Borglum |
| 3,886,425 | A | 5/1975 | Weiss |
| 3,891,115 | A | 6/1975 | Ono |
| 4,014,457 | A | 3/1977 | Hodge |
| 4,027,774 | A | 6/1977 | Cote |
| 4,081,105 | A | 3/1978 | Dagonnet et al. |
| 4,189,808 | A | 2/1980 | Brown |
| 4,200,197 | A | 4/1980 | Meyer et al. |
| 4,217,616 | A | 8/1980 | Jessup |
| 4,303,174 | A | 12/1981 | Anderson |
| 4,320,851 | A | 3/1982 | Montoya |
| 4,357,740 | A | 11/1982 | Brown |
| 4,416,197 | A | 11/1983 | Kehl |
| 4,457,483 | A | 7/1984 | Gagne |
| 4,535,911 | A | 8/1985 | Goulter |
| 4,570,304 | A | 2/1986 | Montreuil et al. |
| 4,576,310 | A | 3/1986 | Isgar et al. |
| D284,320 | S | 6/1986 | Kubic et al. |
| 4,609,117 | A | 9/1986 | Pamment |
| 4,630,332 | A | 12/1986 | Bisbing |
| 4,630,752 | A | 12/1986 | DeMars |
| 4,664,347 | A | 5/1987 | Brown et al. |
| 4,697,312 | A | 10/1987 | Freyer |
| 4,711,161 | A | 12/1987 | Swin et al. |
| 4,729,490 | A | 3/1988 | Ziegenbein |
| 4,753,367 | A | 6/1988 | Miller et al. |
| 4,763,808 | A | 8/1988 | Guhl et al. |
| 4,765,548 | A | 8/1988 | Sing |
| 4,765,579 | A | 8/1988 | Robbins et al. |
| 4,792,039 | A | 12/1988 | Dayton |
| 4,794,973 | A | 1/1989 | Perisic |
| 4,834,260 | A | 5/1989 | Auten |
| 4,863,053 | A | 9/1989 | Oberg |
| 4,867,339 | A | 9/1989 | Hahn |
| 4,884,717 | A | 12/1989 | Bussard et al. |
| 4,892,224 | A | 1/1990 | Graham |
| 4,913,308 | A | 4/1990 | Culbertson |
| 4,918,568 | A | 4/1990 | Stone et al. |
| 4,923,087 | A | 5/1990 | Burrows |
| 4,948,004 | A | 8/1990 | Chich |
| 4,964,523 | A | 10/1990 | Bieltvedt et al. |
| 4,972,966 | A | 11/1990 | Craft, Jr. |
| 4,996,467 | A | 2/1991 | Day |
| 5,031,793 | A | 7/1991 | Chen et al. |
| 5,048,903 | A | 9/1991 | Loblein |
| 5,054,724 | A | 10/1991 | Hutcheson |
| 5,065,272 | A | 11/1991 | Owen et al. |
| 5,065,891 | A | 11/1991 | Casey |
| 5,090,785 | A | 2/1992 | Stamp |
| 5,100,087 | A | 3/1992 | Ashby |
| 5,111,958 | A | 5/1992 | Witthoeft |
| D327,760 | S | 7/1992 | Donnelly |
| D329,929 | S | 9/1992 | Knoedler et al. |
| 5,147,055 | A | 9/1992 | Sampson et al. |
| 5,156,290 | A | 10/1992 | Rodrigues |
| 5,170,904 | A | 12/1992 | Neuhaus |
| 5,174,462 | A | 12/1992 | Hames |
| D335,562 | S | 5/1993 | Evans |
| 5,213,272 | A | 5/1993 | Gallagher et al. |
| 5,222,704 | A | 6/1993 | Light |
| 5,226,558 | A | 7/1993 | Whitney et al. |
| 5,230,525 | A | 7/1993 | Delmerico et al. |
| 5,242,074 | A | 9/1993 | Conaway et al. |
| D340,333 | S | 10/1993 | Duran et al. |
| 5,249,693 | A | 10/1993 | Gillispie et al. |
| 5,261,553 | A | 11/1993 | Mueller et al. |
| 5,314,151 | A | 5/1994 | Carter-Mann |
| 5,322,179 | A | 6/1994 | Ting |
| 5,348,222 | A | 9/1994 | Patey |
| 5,381,588 | A | 1/1995 | Nelson |
| 5,385,258 | A | 1/1995 | Sutherlin |
| 5,390,818 | A | 2/1995 | LaBuda |
| 5,404,621 | A | 4/1995 | Heinke |
| 5,407,089 | A | 4/1995 | Bird et al. |
| 5,419,452 | A | 5/1995 | Mueller et al. |
| 5,471,708 | A | 12/1995 | Lynch |
| 5,474,201 | A | 12/1995 | Liu |
| 5,501,358 | A | 3/1996 | Hobday |
| 5,520,067 | A | 5/1996 | Gabas |
| 5,520,303 | A | 5/1996 | Bernstein et al. |
| 5,531,348 | A | 7/1996 | Baker et al. |
| 5,535,913 | A | 7/1996 | Asbach et al. |
| 5,558,254 | A | 9/1996 | Anderson et al. |
| D377,554 | S | 1/1997 | Adriaansen |
| 5,611,507 | A | 3/1997 | Smith |
| 5,628,424 | A | 5/1997 | Gola |
| 5,632,401 | A | 5/1997 | Hurd |
| 5,636,416 | A | 6/1997 | Anderson |
| 5,644,111 | A | 7/1997 | Cerny et al. |
| 5,645,186 | A | 7/1997 | Powers et al. |
| 5,650,680 | A | 7/1997 | Chula |
| D383,277 | S | 9/1997 | Peters |
| 5,662,235 | A | 9/1997 | Nieto |
| 5,690,247 | A | 11/1997 | Boover |
| 5,695,088 | A | 12/1997 | Kasbohm |
| 5,699,929 | A | 12/1997 | Ouno |
| D388,922 | S | 1/1998 | Peters |
| D389,631 | S | 1/1998 | Peters |
| 5,704,511 | A | 1/1998 | Kellams |
| 5,724,837 | A | 3/1998 | Shin |
| 5,730,312 | A | 3/1998 | Hung |
| 5,732,845 | A | 3/1998 | Armaly, Jr. |
| 5,735,495 | A | 4/1998 | Kubota |
| 5,738,239 | A | 4/1998 | Triglia |
| 5,799,909 | A | 9/1998 | Ziegler |
| 5,816,431 | A | 10/1998 | Giannopoulos |
| 5,816,640 | A | 10/1998 | Nishimura |
| D401,719 | S | 11/1998 | Van Leeuwen et al. |
| 5,873,643 | A | 2/1999 | Burgess, Jr. et al. |
| 5,881,896 | A | 3/1999 | Presnell et al. |
| 5,881,901 | A | 3/1999 | Hampton |
| 5,884,237 | A | 3/1999 | Kanki et al. |
| 5,887,748 | A | 3/1999 | Nguyen |
| 5,967,392 | A | 10/1999 | Niemi et al. |
| 5,987,708 | A | 11/1999 | Newton |
| 6,000,569 | A | 12/1999 | Liu |
| 6,010,024 | A | 1/2000 | Wang |
| 6,024,238 | A | 2/2000 | Jaros |
| 6,036,050 | A | 3/2000 | Ruane |
| 6,102,239 | A | 8/2000 | Wien |
| 6,123,215 | A | 9/2000 | Windle |
| D431,700 | S | 10/2000 | Roudebush |
| 6,126,031 | A | 10/2000 | Reason |
| 6,129,233 | A | 10/2000 | Schiller |
| D435,951 | S | 1/2001 | Yang et al. |
| 6,209,744 | B1 | 4/2001 | Gill |
| 6,211,637 | B1 | 4/2001 | Studer |
| 6,234,339 | B1 | 5/2001 | Thomasd |
| 6,250,492 | B1 | 6/2001 | Verbeek |
| D445,980 | S | 7/2001 | Tjugum |
| 6,286,706 | B1 | 9/2001 | Tucker |
| 6,328,320 | B1 | 12/2001 | Walski et al. |
| 6,345,725 | B1 | 2/2002 | Lin |
| 6,364,147 | B1 | 4/2002 | Meinzinger et al. |
| 6,386,386 | B1 | 5/2002 | George |
| 6,390,321 | B1 | 5/2002 | Wang |
| 6,401,958 | B1 | 6/2002 | Foss et al. |
| 6,519,130 | B1 | 2/2003 | Breslow |
| 6,557,716 | B1 | 5/2003 | Chan |
| 6,596,983 | B2 | 7/2003 | Brent |
| 6,626,316 | B2 | 9/2003 | Yang |
| 6,626,317 | B2 | 9/2003 | Pfiefer et al. |
| D482,169 | S | 11/2003 | Lin |
| 6,659,407 | B2 | 12/2003 | Asaro |
| 6,681,950 | B2 | 1/2004 | Miller, Jr. et al. |
| D488,604 | S | 4/2004 | Yang et al. |
| D488,903 | S | 4/2004 | Yang et al. |

(56) References Cited

U.S. PATENT DOCUMENTS

| | | | |
|---|---|---|---|
| D489,503 | S | 5/2004 | Lin |
| D489,857 | S | 5/2004 | Yang et al. |
| D490,583 | S | 5/2004 | Yang et al. |
| D490,954 | S | 6/2004 | Brand |
| D491,706 | S | 6/2004 | Yang et al. |
| 6,758,366 | B2 | 7/2004 | Bourgund et al. |
| D493,930 | S | 8/2004 | Wang |
| D494,723 | S | 8/2004 | Lin |
| 6,812,655 | B1 | 11/2004 | Wang et al. |
| 6,814,249 | B2 | 11/2004 | Lin |
| 6,837,393 | B1 | 1/2005 | Kuo |
| 6,857,538 | B2 | 2/2005 | Lin |
| 6,859,005 | B2 | 2/2005 | Boliver |
| D503,021 | S | 3/2005 | Yang et al. |
| 6,866,826 | B2 | 3/2005 | Moore et al. |
| 6,883,676 | B2 | 4/2005 | Lin |
| D507,090 | S | 7/2005 | Yang et al. |
| 6,920,994 | B2 | 7/2005 | Lin |
| 6,974,948 | B1 | 12/2005 | Brent |
| D513,445 | S | 1/2006 | Lin |
| 6,981,606 | B2 | 1/2006 | Yang et al. |
| D517,764 | S | 3/2006 | Wang |
| D517,767 | S | 3/2006 | Yang et al. |
| D518,266 | S | 3/2006 | Yang et al. |
| 7,017,773 | B2 | 3/2006 | Gruber et al. |
| 7,044,323 | B2 | 5/2006 | Yang |
| D525,756 | S | 7/2006 | Yang et al. |
| 7,073,677 | B2 | 7/2006 | Richardson et al. |
| 7,077,283 | B2 | 7/2006 | Yang et al. |
| 7,080,750 | B2 | 7/2006 | Wein et al. |
| 7,086,550 | B2 | 8/2006 | Yang et al. |
| D528,726 | S | 9/2006 | Lin |
| 7,121,421 | B2 | 10/2006 | Yang et al. |
| D535,799 | S | 1/2007 | Epps |
| D535,800 | S | 1/2007 | Yang et al. |
| D537,223 | S | 2/2007 | Lin |
| D537,599 | S | 2/2007 | Lin |
| D537,601 | S | 2/2007 | Lin |
| D537,999 | S | 3/2007 | Lin |
| D538,995 | S | 3/2007 | Lin |
| D539,498 | S | 3/2007 | Yang et al. |
| D539,499 | S | 3/2007 | Yang et al. |
| D540,001 | S | 4/2007 | Zimmerman |
| D542,001 | S | 5/2007 | Yang et al |
| D542,995 | S | 5/2007 | Lin |
| D544,170 | S | 6/2007 | Lin |
| D544,171 | S | 6/2007 | Lin |
| D544,671 | S | 6/2007 | Saunders et al. |
| D545,024 | S | 6/2007 | Liao |
| 7,225,943 | B2 | 6/2007 | Yang et al. |
| D547,020 | S | 7/2007 | Chen |
| 7,243,811 | B1 | 7/2007 | Ramsey |
| D550,918 | S | 9/2007 | Wang et al. |
| D552,321 | S | 10/2007 | Yang et al. |
| D552,823 | S | 10/2007 | Yang et al. |
| D552,824 | S | 10/2007 | Zimmerman |
| D552,825 | S | 10/2007 | Yang et al. |
| D559,494 | S | 1/2008 | Yang et al. |
| D559,495 | S | 1/2008 | Yang et al. |
| 7,328,842 | B2 | 2/2008 | Wagner et al. |
| D564,169 | S | 3/2008 | Wang |
| D566,367 | S | 4/2008 | Lin |
| D566,369 | S | 4/2008 | Shek |
| D566,923 | S | 4/2008 | Lin |
| 7,374,060 | B2 | 5/2008 | Yang et al. |
| D571,520 | S | 6/2008 | Lin |
| 7,404,499 | B1 | 7/2008 | Ramsey |
| D576,371 | S | 9/2008 | Zimmerman |
| D578,266 | S | 10/2008 | Yang et al. |
| D578,722 | S | 10/2008 | Yang et al. |
| 7,438,199 | B1 | 10/2008 | Tidrick |
| D580,120 | S | 11/2008 | Lin |
| D580,613 | S | 11/2008 | Yang et al. |
| D580,615 | S | 11/2008 | Yang et al. |
| D585,618 | S | 1/2009 | Yang et al. |
| 7,494,021 | B2 | 2/2009 | Yang et al. |
| 7,540,396 | B2 | 6/2009 | Yang et al. |
| 7,543,716 | B2 | 6/2009 | Lin |
| 7,559,433 | B2 | 7/2009 | Yang et al. |
| D603,119 | S | 10/2009 | Yang et al. |
| 7,607,552 | B2 | 10/2009 | Efstathiou |
| 7,621,420 | B2 | 11/2009 | Bandoh et al. |
| 7,656,109 | B2 | 2/2010 | Yang et al. |
| D611,216 | S | 3/2010 | Yang et al. |
| D611,671 | S | 3/2010 | Yang et al. |
| 7,694,838 | B2 | 4/2010 | Yang et al. |
| 7,703,622 | B1 | 4/2010 | Bynoe |
| D615,722 | S | 5/2010 | Yang et al. |
| 7,712,285 | B2 | 5/2010 | Stravitz et al. |
| 7,741,801 | B2 | 6/2010 | Fukuizumi |
| 7,748,556 | B2 | 7/2010 | Yang et al. |
| 7,781,995 | B2 | 8/2010 | Yang et al. |
| 7,806,285 | B2 | 10/2010 | Yang et al. |
| D631,221 | S | 1/2011 | Yang et al. |
| D632,864 | S | 2/2011 | Yang et al. |
| D634,911 | S | 3/2011 | Yang et al. |
| 7,896,187 | B2 | 3/2011 | Haibel |
| 7,922,024 | B2 | 4/2011 | Yang et al. |
| 7,950,543 | B2 | 5/2011 | Yang et al. |
| D644,390 | S | 8/2011 | Smeets et al. |
| 7,992,742 | B1 | 8/2011 | Kim |
| 8,006,857 | B2 | 8/2011 | Lin |
| 8,074,833 | B2 | 12/2011 | Yang et al. |
| 8,136,688 | B2 | 3/2012 | Lee et al. |
| D657,108 | S | 4/2012 | Yang et al. |
| D657,109 | S | 4/2012 | Liao |
| D672,520 | S | 12/2012 | Yang et al. |
| D675,802 | S | 2/2013 | Yang et al. |
| D675,803 | S | 2/2013 | Yang et al. |
| 8,418,869 | B2 | 4/2013 | Yang et al. |
| 2001/0002690 | A1 | 6/2001 | Rosky |
| 2001/0020619 | A1 | 9/2001 | Pfeifer et al. |
| 2002/0079315 | A1 | 6/2002 | Yang |
| 2002/0092853 | A1 | 7/2002 | Wang |
| 2002/0096524 | A1 | 7/2002 | Hardesty |
| 2002/0104266 | A1 | 8/2002 | Ranaudo |
| 2003/0089719 | A1 | 5/2003 | Berger |
| 2003/0201265 | A1 | 10/2003 | Lin |
| 2003/0201267 | A1 | 10/2003 | Yang et al. |
| 2003/0230576 | A1 | 12/2003 | Lin |
| 2004/0004080 | A1 | 1/2004 | Yang et al. |
| 2004/0016756 | A1 | 1/2004 | Lin |
| 2004/0020927 | A1 | 2/2004 | Yang et al. |
| 2004/0134924 | A1 | 7/2004 | Hansen et al. |
| 2004/0140782 | A1 | 7/2004 | Okabe et al. |
| 2004/0164077 | A1 | 8/2004 | Kuo |
| 2004/0174268 | A1 | 9/2004 | Scott et al. |
| 2004/0175303 | A1 | 9/2004 | Lin |
| 2004/0199401 | A1 | 10/2004 | Wagner |
| 2004/0200938 | A1 | 10/2004 | Forlivio |
| 2004/0206758 | A1 | 10/2004 | Lin |
| 2004/0206760 | A1 | 10/2004 | Gagnebin |
| 2004/0251746 | A1 | 12/2004 | Ichimaru et al. |
| 2005/0017006 | A1 | 1/2005 | Kuo |
| 2005/0017010 | A1 | 1/2005 | Siegel et al. |
| 2005/0103788 | A1 | 5/2005 | Yang et al. |
| 2005/0133506 | A1 | 6/2005 | Yang et al. |
| 2005/0230396 | A1 | 10/2005 | Yang et al. |
| 2005/0230397 | A1 | 10/2005 | Yang et al. |
| 2005/0258794 | A1 | 11/2005 | Fukuizumi |
| 2005/0284870 | A1 | 12/2005 | Yang et al. |
| 2006/0027579 | A1 | 2/2006 | Yang et al. |
| 2006/0056741 | A1 | 3/2006 | Yang et al. |
| 2006/0103086 | A1 | 5/2006 | Niemeyer et al. |
| 2006/0175336 | A1 | 8/2006 | Wang |
| 2006/0186121 | A1 | 8/2006 | Yang et al. |
| 2006/0196874 | A1 | 9/2006 | Yang |
| 2006/0213910 | A1 | 9/2006 | Yang et al. |
| 2006/0226149 | A1 | 10/2006 | Yang et al. |
| 2006/0249510 | A1 | 11/2006 | Lin |
| 2006/0255033 | A1 | 11/2006 | Yang et al. |
| 2006/0261071 | A1 | 11/2006 | Yang et al. |
| 2006/0278643 | A1 | 12/2006 | Chiou |
| 2007/0012699 | A1 | 1/2007 | Yang et al. |

(56) References Cited

U.S. PATENT DOCUMENTS

| | | | |
|---|---|---|---|
| 2007/0029323 | A1 | 2/2007 | Yang et al. |
| 2007/0034334 | A1 | 2/2007 | Ramsey et al. |
| 2007/0090112 | A1 | 4/2007 | Kalman et al. |
| 2007/0114847 | A1 | 5/2007 | Ichimaru et al. |
| 2007/0181579 | A1 | 8/2007 | Kuo et al. |
| 2007/0182551 | A1 | 8/2007 | Yang et al. |
| 2007/0205195 | A1 | 9/2007 | Yang et al. |
| 2007/0241109 | A1 | 10/2007 | Lin |
| 2007/0266637 | A1 | 11/2007 | McGowan |
| 2007/0272691 | A1 | 11/2007 | Wang et al. |
| 2007/0289972 | A1 | 12/2007 | Wynn et al. |
| 2008/0011754 | A1 | 1/2008 | Ramsey |
| 2008/0011910 | A1 | 1/2008 | Ramsey |
| 2008/0083756 | A1 | 4/2008 | Daniels |
| 2008/0164257 | A1 | 7/2008 | Boll et al. |
| 2008/0236275 | A1 | 10/2008 | Breed et al. |
| 2008/0237234 | A1 | 10/2008 | Yang et al. |
| 2008/0257889 | A1 | 10/2008 | Kovacevich et al. |
| 2008/0257890 | A1 | 10/2008 | Kovacevich et al. |
| 2008/0257891 | A1 | 10/2008 | Kovacevich et al. |
| 2008/0264948 | A1 | 10/2008 | Kovacevich et al. |
| 2008/0264950 | A1 | 10/2008 | Kovacevich et al. |
| 2008/0272119 | A1 | 11/2008 | Efstathiou |
| 2008/0272127 | A1 | 11/2008 | Kovacevich et al. |
| 2009/0084788 | A1 | 4/2009 | Yang et al. |
| 2009/0194532 | A1 | 8/2009 | Yang et al. |
| 2009/0230131 | A1 | 9/2009 | McDuffie et al. |
| 2009/0261105 | A1 | 10/2009 | Cunningham et al. |
| 2009/0266836 | A1 | 10/2009 | Mobley |
| 2010/0006572 | A1 | 1/2010 | Chiou |
| 2010/0170904 | A1 | 7/2010 | Kalman et al. |
| 2010/0224627 | A1 | 9/2010 | Yang et al. |
| 2010/0237074 | A1 | 9/2010 | Yang et al. |
| 2011/0139781 | A1 | 6/2011 | Jin et al. |
| 2011/0220646 | A1 | 9/2011 | Yang et al. |
| 2011/0220647 | A1 | 9/2011 | Yang et al. |
| 2011/0220648 | A1 | 9/2011 | Yang et al. |
| 2011/0220655 | A1 | 9/2011 | Yang et al. |

FOREIGN PATENT DOCUMENTS

| | | | |
|---|---|---|---|
| CA | 132181 | | 6/2010 |
| CA | 136938 | | 5/2011 |
| CA | 141819 | | 4/2012 |
| CA | 146601 | | 2/2013 |
| DE | 1610087 | | 6/1950 |
| DE | 1283741 | | 7/1966 |
| DE | 8436939 | | 3/1985 |
| DE | 9108341 | | 10/1991 |
| DE | 4225936 | A1 | 2/1994 |
| DE | 19525885 | | 3/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| EP | 0582240 | | 7/1993 |
| EP | 0903305 | A1 | 3/1999 |
| EP | 0906876 | | 4/1999 |
| EP | 1094017 | | 4/2001 |
| EP | 1361176 | | 11/2003 |
| EP | 1136393 | | 4/2004 |
| EP | 1647503 | A1 | 4/2006 |
| EP | 1686073 | | 8/2006 |
| EP | 1686073 | A1 | 8/2006 |
| EP | 1918223 | A1 | 5/2008 |
| EP | 1700799 | B1 | 8/2009 |
| EP | 001164826-0001 | | 9/2009 |
| EP | 001232904-0001 | | 10/2010 |
| EP | 001908575-0001 | | 8/2011 |
| EP | 001317416-0001 | | 4/2012 |
| EP | 001317416-0002 | | 4/2012 |
| EP | 001335285-0001 | | 7/2012 |
| EP | 001335293-0001 | | 7/2012 |
| FR | 2887152 | | 12/2006 |
| GB | 191004921 | | 0/1910 |
| GB | 2384418 | | 7/2003 |
| JP | 02 152670 | | 6/1990 |
| JP | 06-272888 | | 9/1994 |
| JP | D1300450 | | 5/2007 |
| JP | D1300451 | | 5/2007 |
| JP | D1322056 | | 2/2008 |
| KR | 3003841370000 | | 6/2005 |
| KR | 3004095430000 | | 3/2006 |
| KR | 3004095430001 | | 7/2006 |
| NL | 6908550 | | 12/1970 |
| TW | D112733 | | 9/2006 |
| TW | D129485 | | 7/2009 |
| TW | D133382 | | 2/2010 |
| TW | D133678 | | 3/2010 |
| TW | D147147 | | 5/2012 |
| WO | WO 92/02430 | | 2/1992 |
| WO | WO 2006-079263 | | 8/2006 |
| WO | WO 2007/139570 | | 12/2007 |
| WO | WO 2009/114495 | | 9/2009 |

OTHER PUBLICATIONS

U.S. Appl. No. 13/783,149, filed Mar. 1, 2013, Yang et al.

U.S. Appl. No. 29/447,313, filed Mar. 1, 2013, Yang et al.

European Search Report for European Application No. 06010394, dated Aug. 24, 2006, in 1 page.

European Search Report for Application No. EP 10002273, dated Jan. 4, 2011, in 9 pages.

Partial European Search Report for Application No. EP 10002273, dated Jul. 2, 2010, in 4 pages.

Trento Corner 23 Trash Can, Hailo product brochure, http://www.hailo.de/html/default.asp?site=12_71_107&lang=en.

RECEPTACLE WITH MOTION DAMPERS FOR LID AND AIR FILTRATION DEVICE

CROSS-REFERENCE TO RELATED APPLICATIONS

This application is a continuation of U.S. patent application Ser. No. 12/399,828, filed on Mar. 6, 2009, titled "RECEPTACLE WITH MOTION DAMPERS FOR LID AND AIR FILTRATION DEVICE," which is hereby incorporated by reference in its entirety.

BACKGROUND

1. Field

The present inventions relate to receptacles having doors or lids, some of the inventions relating to mechanisms configured to slow at least the closing movement of the lid, some of the inventions relating to air filtration devices for receptacles, and some inventions relating to mechanisms designed to reduce unintended sliding of a receptacle during use.

2. Description of the Related Art

Receptacles and other devices having lids or doors are used in a variety of different settings. For example, in both residential and commercial settings, trashcans and other devices often have lids or doors for preventing the escape of the contents from the receptacle. In the context of trashcans, some trashcans include lids or doors to prevent odors from escaping and to hide the trash within the receptacle from view. Additionally, the lid of a trashcan helps prevent contamination from escaping from the receptacle.

Recently, trashcans with rotary-type motion dampers for slowing the motion of the lids have become commercially available. More specifically, these rotary dampening mechanisms are connected to the lids of the trashcans so as to slow the closing movement of the lids. As such, the trashcan is more aesthetically pleasing because the lid closes slowly, thereby preventing a loud slamming noise when the lid is moved to a closing position.

These types of trashcans often are pedal-actuated, i.e., they include a foot pedal which is connected to the lid for moving the lid toward the open position. The rotary mechanisms are connected to the internal linkage connecting the foot pedal to the lid so as to slow the closing movement of the lid.

SUMMARY

An aspect of at least one of the embodiments disclosed herein includes the realization that when a receptacle, such as a trashcan, is provided with a larger actuation mechanism, such as a large foot pedal, unbalanced loads can be applied to such a foot pedal, causing unbalanced movements of the foot pedal. For example, in some of the embodiments disclosed herein, a trashcan includes a foot pedal connected to the trashcan at two laterally opposite positions relative to a side of the trashcan. As such, when such a pedal is depressed at a location offset from a center of the pedal, the pedal bar can be twisted. Further, if a motion damper is provided, the dampened movement of the pedal can also be unbalanced, thereby allowing the pedal to remain twisted during movement.

Thus, in accordance with an embodiment, a trash can comprise a body defining an interior space, the body can comprise a base portion and an upper body portion, and a lid can be moveably mounted to the body so as to be moveable between open and closed positions. At least first and second pedal pivots can be supported by the body and disposed on opposite lateral positions of a side of the body. A pedal can be moveably mounted to the body with the first and second pedal pivots such that the pedal is moveable between resting and actuated positions. The pedal can also be mechanically interfaced to the lid so as to move the lid from its closed position to its open position when the pedal is moved from its resting position to its actuated position. The pedal can comprise a pedal member extending laterally across a side of the body, a first end of the pedal member pivotally supported by the first pedal pivot and a second end of the pedal member being pivotally supported by the second pedal pivot. A first motion damper can be connected to the first end of the pedal member. A second motion damper can be connected to the second end of the pedal member, wherein the first and second dampers can be configured to dampen at least a first movement of the pedal member from the actuated position to the resting position.

Another aspect of at least one of the embodiments disclosed herein includes the realization that when a user depresses a pedal of a pedal actuated trashcan lid, the trashcan can slide across the floor away from the user. Additionally, some users of such trashcans prefer that trashcan be easily movable across a floor. Thus, there is a difficulty in designing a trashcan that is both easily movable and slidable across a floor yet resistant to movement caused by the forces generated during actuation of a foot pedal.

Thus, in accordance with another embodiment, a trash can can comprise a body defining an interior space, the body comprising a base portion and an upper body portion and a pedal pivotally mounted to the body, so as to be moveable at least between resting and actuated positions. A friction device can be configured to increase a resistance against a sliding motion of the trash can across a surface as the pedal is moved between the resting and actuated positions, the friction device being connected to the pedal such that a force pressing the friction device against a surface upon which the trash can rests increases as the pedal is moved to its actuated position.

Another aspect of at least one of the embodiments disclosed herein includes the realization that it can be advantageous to dampen the opening movement of a lid of a trashcan. For example, some users place trashcans close to a wall. Thus, if the lid of the trashcan is open rapidly, the lid can impact the closely spaced wall and thus create a noise or damage to the lid or wall. Additionally, when lids of trashcans are opened rapidly, the hinge mechanism attaching the lid to the trashcan body can be overstressed, thereby damaging the hinge mechanism and/or other mechanisms.

Thus, in accordance with another embodiment, a trash can can comprise a body defining an interior space and the body can comprise a base portion and an upper body portion. A lid can be moveably mounted to the body, the lid being moveable between open and closed positions. At least one motion damper can be configured to dampen the movement of the lid from the open position toward the closed position and to dampen the movement of the lid from the closed position to the open position.

A further aspect of at least one of the embodiments disclosed herein includes the realization that trashcans with lids, even if they include air filtration devices, often discharge trash odors as the lid closes. Additionally, depending on the orientation of the lid, the odors can be discharged directly at the user of the trashcan.

Thus, in accordance with another embodiment, a trash can can comprise a body defining an interior space and the body can comprise a base portion and an upper body portion. A lid can be movably mounted to the body so as to be movable between opened and closed positions. An air filtration device can be mounted to the trash can. An air guide can be mounted to the trash can and can be configured to guide air through the air filtration device and then downwardly into the interior space as the lid moves from the open position toward the closed position.

BRIEF DESCRIPTION OF THE DRAWINGS

The above mentioned and other features of the inventions disclosed herein are described below with reference to the drawings of preferred embodiments. The illustrated embodiments are intended to illustrate, but not to limit the inventions. The drawings contain the following figures.

DETAILED DESCRIPTION

The embodiments of a receptacle with a lid having at least one dampening device for dampening motion of the lid, an air filtration mechanism, and an anti-sliding device are all disclosed in the context of a trashcan. The inventions disclosed herein are described in the context of a trashcan because they have particular utility in this context. However, the inventions disclosed herein can be used in other contexts as well, including, for example, but without limitation, large commercial trashcans, doors, windows, security gates, and other larger doors or lids, as well as doors or lids for smaller devices, such as high precision scales, computer drives, etc.

Figure 1:
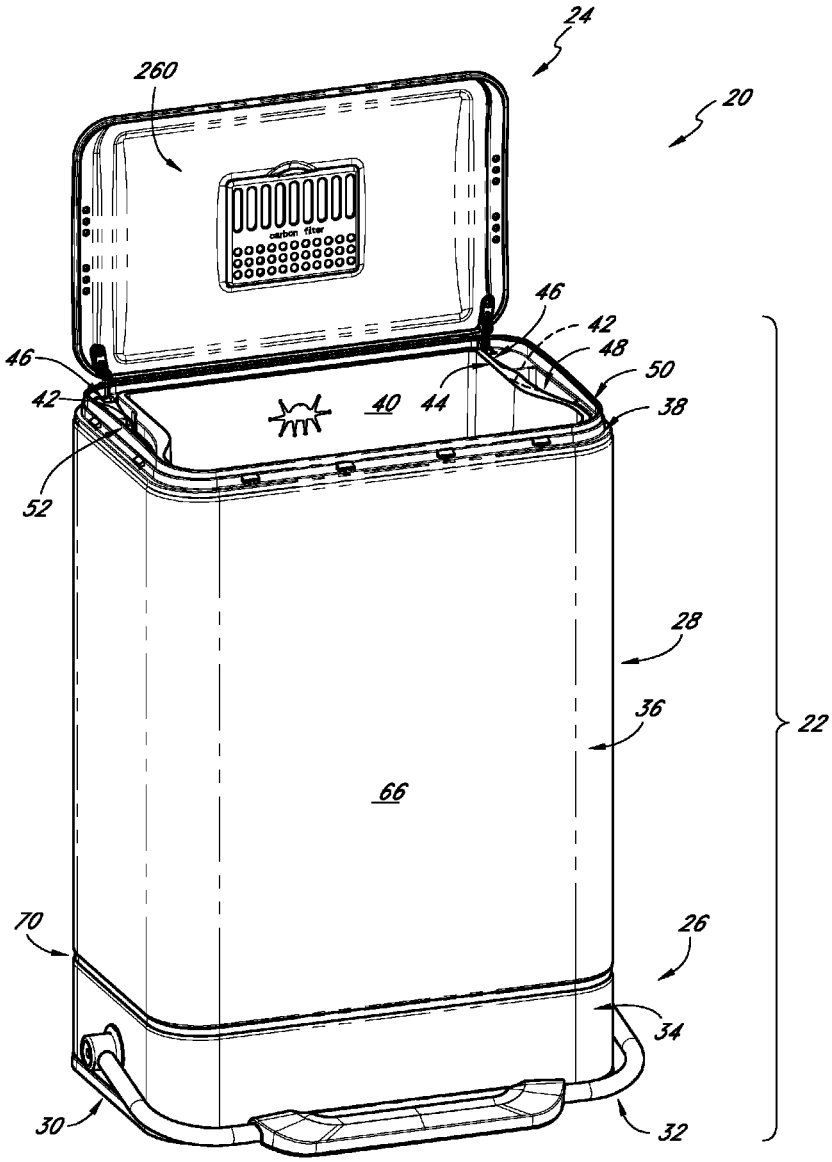
FIG. 1 is a top, front, and right side perspective view of a receptacle assembly in accordance with an embodiment, having a pedal-actuated lid and with the lid in its opened position.
Figure 2:
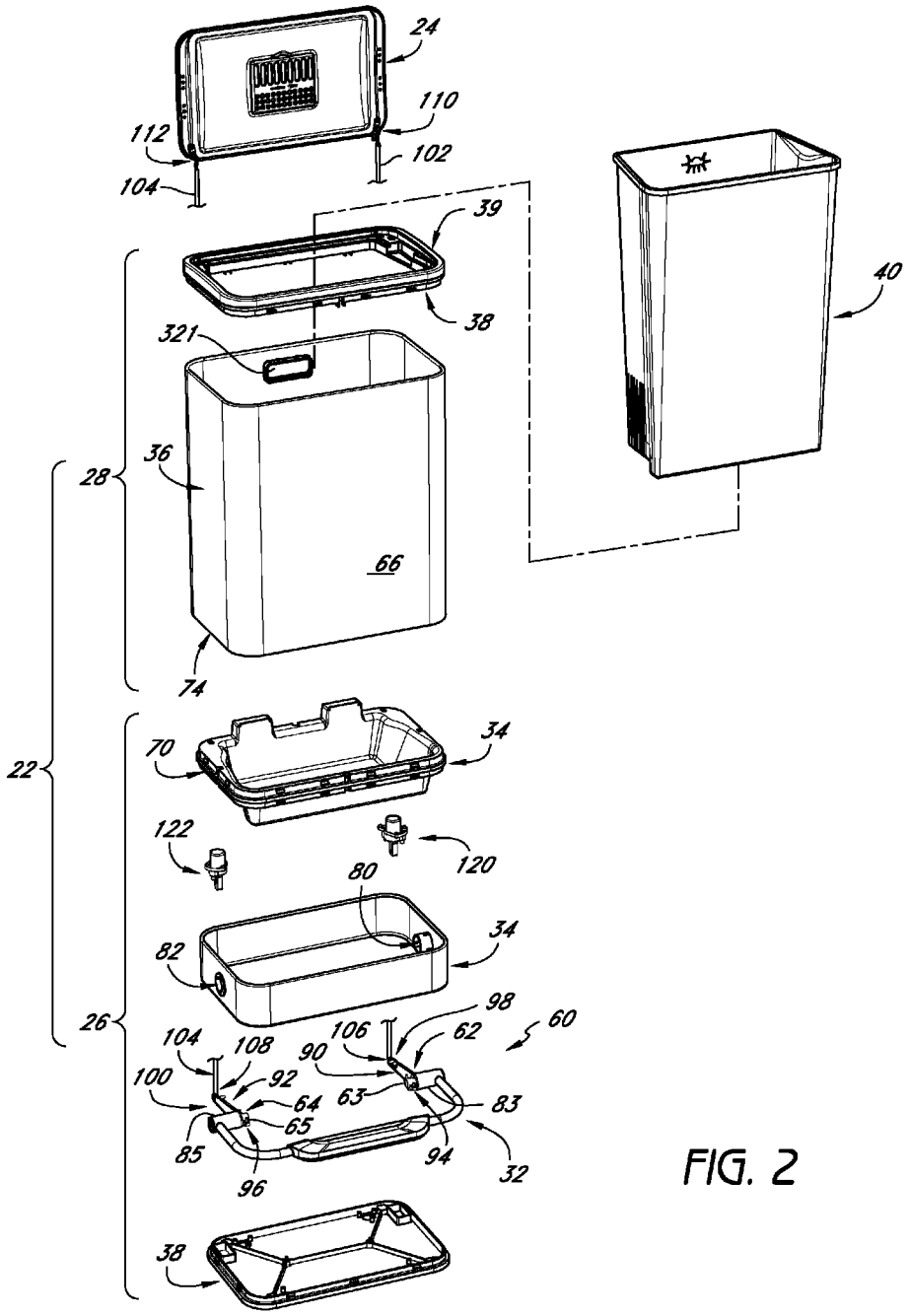
FIG. 2 is an exploded and perspective view of the trashcan illustrated in FIG. 1.

FIGS. 1 and 2 illustrate an embodiment of a receptacle assembly 20. The assembly can include a body portion 22 and a lid portion 24 configured to move between opened and closed positions relative to the body 22, the open position being illustrated in FIG. 1.

The body 22 can include a base portion 26 and an upper body portion 28. The base portion 26 and the upper body portion 28 can be made from a single monolithic piece or from separate pieces connected together.

In the illustrated embodiment, the base portion includes a lower end 30 configured to support the receptacle 20 in a stable resting position when the trashcan assembly 20 rests on a surface such as a floor, which may be smooth, or uneven. The base portion 26 can be configured to support the upper body portion 28 such that the upper portion 28 can extend upwardly from the base 26.

The base portion 26 can also provide a mounting arrangement for a pedal 32. The trashcan assembly 20 can further include a mechanism configured to move the lid 24 from the closed to open positions when the pedal 32 is depressed, i.e., from a resting position to an actuating position, discussed in greater detail below.

The base portion 26 can be made from a single monolithic piece and/or from separate components connected together. In some embodiments, the base portion 26 includes an outer shell 34 which defines an interior cavity. In some embodiments, the outer shell 34 can be formed from sheet metals, such as sheet stainless steel, or other metals, or other materials including plastics, etc. In some embodiments, when sheet metal is used, such as sheet stainless steel, the shell 36 can be made from any of 23-26 gauge stainless sheet steel. Of course, the thinner the gauge sheet steel, the lighter and less expensive the shell 36 will be.

The upper body portion 28 can also include an outer shell 36 which defines an interior cavity. In some embodiments, the outer shell 36 can be configured to correspond to the shape of the outer surface of the shell 34.

The upper body portion can also include an upper support member 38 supported by an upper end of the shell 36. The upper support member 38 can be made monolithically with the shell 36 or it can be made from separate components attached to the shell 36. Similar to the shell 34, the shell 36 can be made from any material, including sheet metals, such as stainless steel (e.g., 23-26 gauge stainless sheet steel as noted above), other metals, or other plastics.

The upper support member 38 can be configured to support a liner 40 within the interior cavity defined by the shells 34 and/or 36. In some embodiments, the upper support member 38 includes a shoulder 42 configured to support an outwardly extending lip 44 of the liner 40. As such, the liner 40 can hang within the shells 34 and/or 36 from the upper support member 38. However, in other configurations, the liner 40 can rest upon an interior surface of the upper body 28 or the base 26. In such a configuration, the upper support member 38, while it does not support the weight of the liner 40, can provide for alignment of the liner 40 within the body 22.

The upper support member 38 can also include one or more apertures 46 configured to allow a portion of a lid opening mechanism to extend therethrough, described in greater detail below.

The upper support member 38 can also include additional apertures 48 which can allow air to flow into a space between the liner 40 and an interior surface of the shell 36, also described in greater detail below.

The lid 24 can be moveably mounted to the body 22 with any known device, such as a hinge which can allow pivoting motion of the lid 24, or other devices providing different movements. The connection between the lid 24 and the body 22 can be constructed so as to connect the lid 24 to the upper support member 38 or directly to the shell 36.

Although not illustrated in FIG. 1 or 2, the trashcan assembly 20 can also include an additional trim ring 39 (FIG. 2) extending around an outer surface of the upper support member 38. In some embodiments, the additional trim ring 39 can be made from the same material as the shell 36 so as to provide a consistent outer appearance.

As illustrated in FIG. 1, the upper support member 38 can include a peripheral wall 50 extending around the entire periphery of the support member 38. However, the wall 50 can include cutouts, notches, or gaps if desired.

Further, the upper support member 38 can include additional recesses configured to allow a user to insert their fingers below the flange 44 of the liner 40 so as to allow a user to conveniently lift the liner 40 out of the body 22. The wall 50 can also include an outer surface 52 that is configured to cooperate with a corresponding surface on the lid 24, described in greater detail below.

With continued reference to FIG. 2, as noted above, a lid opening mechanism 60 can be configured to move the lid 24 from the closed to opened positions when the pedal 32 is moved from the resting to the actuated position. In some embodiments, as used herein, the phrase "resting position" of the pedal 32 refers to a position where the pedal 32 is pivoted towards an upper position. The actuated position of the pedal 32 can refer to when the pedal 32 is pressed downwardly (as viewed in FIG. 1), for example, by the foot of a user.

To allow for this movement between an upwardly pivoted position corresponding to the resting position, and a downwardly pivoted position corresponding to the actuated position, the pedal 32 can be supported by at least one pivot connection 62. In the illustrated embodiment, there are two pivot connections 62, 64 disposed at laterally opposite positions relative to the front side 66 of the trashcan assembly 20. The pivot mechanisms 62, 64 can be formed in any known manner.

For example, the pivot mechanisms 62, 64 can be formed with bearings supported by and/or defined by the base portion 26. In some embodiments, bearings 80, 82 are supported by the shell 34. In other embodiments, the pivot mechanism 62, 64 can be supported by an additional support member 68 which also can form part of the base portion 62. In the illustrated embodiment, the bearings 80, 82 are in the form of sleeves configured to pivotally support shafts 83, 85 of the pedal 32.

The support portion 68 can be configured to nest within shell 34 and/or the shell 36. In the illustrated embodiment, the support 68 includes an outwardly extending flange 70 which rests on an upper edge 72 of the shell 34. Additionally, the flange 70 can be positioned so as to contact and support a lower edge 74 of the shell 36. Thus, as shown in FIG. 1, the outermost surface of the flange 70 can be approximately flush with the outermost surfaces of the shells 34, 36. However, in other embodiments, the outermost surface of the flange 70 can extend outwardly relative to the outermost surfaces of the shells 34, 36 or can be recessed inwardly from the outermost surfaces of the shells 34, 36.

In some embodiments, the shell 34 can include apertures (not shown) sized to allow portions of the pivot mechanism 62, 64, respectively, to extend therethrough. In some embodiments, first and second pivot shafts 63, 65 extend inwardly from the ends of the pedal 32, and through the bearings 80, 82, respectively. Additionally, in other embodiments, the support member 68 can include apertures (not shown) configured to be aligned with the bearings 80, 82, respectively, and also provide support for the pivot mechanisms 62, 64, respectively or the shafts 63, 65, respectively.

The pivot mechanisms 62, 64 can define pivot axes about which the pedal 32 can pivot. In some embodiments, the pivot axes defined by the pivot mechanism 62, 64 fall along the same axis.

In some embodiments, the mechanism 60 can also include levers 90, 92. The levers 90, 92 can include first ends 94, 96 engaged with the pedal 32 so as to pivot therewith. For example, the first ends 94, 96, can be mounted to the shafts 63, 65, or the shafts 83, 85 so as to rotate therewith. However, other configurations can also be used.

The levers 90, 92 can also include distal ends 98, 100. The distal ends 98, 100 can be connected to one or more members 102, 104 configured to transfer the movement of the pedal 32 between its resting and actuated positions into the movement of the lid 24 between its opened and closed positions.

For example, in some embodiments, the members 102, 104 can be made from a single rod, connected at their lower ends. For example, a single u-shaped rod can form both the members 102, 104. However, in the illustrated embodiment, the members 102, 104 are formed from separate rods. The lower ends of the rods 106, 108 extend into apertures defined in the distal ends 98, 100 of the levers 90, 92. When assembled, the members 102, 104 extend upwardly through the interior of the shell 34, through the support 68, through the interior of the shell 36, through the apertures 46 in the upper support member 38, and to the lid 24.

The upper ends 110, 112 of the members 102, 104 can be configured to interface with the lid 24 so as to pivot the lid 24 relative to the body 22. For example, in some embodiments, the upper ends 110, 112 can press against a portion of the lid 24 radially offset from a pivot axis defined by the hinge connecting the lid 24 to the body 22. As such, the radially offset contact between the upper ends 110, 112 and the lid 24 can cause the lid 24 to pivot about the hinge.

In other embodiments, the lid can include mounting tabs engaging the upper ends 110, 112 in a hinge-type arrangement. As such, the upper ends 110, 112 pivot within the hinge defined by the tabs, and thus move the lid 24 between its opened and closed positions, as the members 102, 104 are moved upward and downwardly in accordance with the movement of the pedal 32. This type of mechanism 60 is well known in the art, and thus, can be modified according to the shape and size of the overall trashcan 20.

In an exemplary configuration, the resting position of the pedal 32 is a position in which the pedal 32 is pivoted upwardly such that the distal ends 98, 100 of the levers 90, 92 are pivoted downwardly. In this position, the members 102, 104 are also pulled into a downward position, which would also correspond to the lid 24 being in a closed position. When a user steps on the pedal 32, thereby pivoting the pedal 32 downwardly, the levers 90, 92, pivoting about the axes defined by the pivot mechanisms 62, 64 pivot upwardly, thereby lifting the rod members 102, 104. As the rod members 102, 104 rise, the upper ends 110, 112 of the members 102, 104 press against the lid 24 or associated tabs, thereby moving the lid 24 from the closed position toward the open position.

With continued reference to FIG. 2, the trashcan assembly 20 can include one or more dampening devices 120, 122. The dampening devices 120, 122 can be any type of dampening device including, for example, but without limitation, rotary dampening devices, friction dampening devices, or fluid damping devices operating with liquid or gaseous working fluids. Other types of dampening mechanisms can also be used.

In some embodiments, the trashcan assembly 20 can include at least two dampening mechanisms, 120, 122 arranged so as to provide dampening against the movement of opposite ends of the pedal 32. The description of the damper 120 set forth below applies to both the dampers 120, 122, although only the damper 120 and the components thereof are specifically identified below. Thus, the damper 122 can have a construction that is similar or identical to the damper 120.

Figure 3:
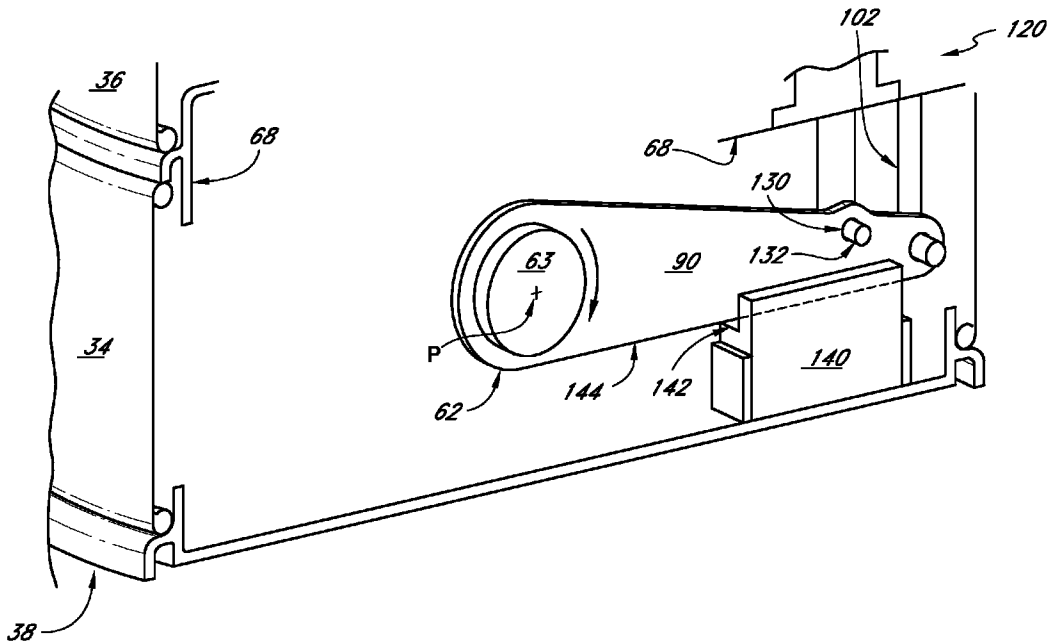
FIG. 3 is an enlarged, perspective, and partial sectional view of a mechanism disposed in the interior of the receptacle of FIG. 1 and connecting the pedal with a mechanism for opening the lid and with a dampening mechanism.

With reference to FIG. 3, the damper mechanism 120 can be attached to a lever 90 in any known manner. In some embodiments, the damper 120 can be connected to the member 102 to thereby connected the damper mechanism 120 to the lever 90. Alternatively, the damper mechanism 120 can be directly connected to the lever 90.

In the illustrated embodiment, the damper mechanism 120 is connected to the lever 90 at an aperture 130. A connecting member 132 of the damper 120, such as a pin, extends through the aperture 130, to thereby connect the lever 90 to the damper 120. In some embodiments, the damper 120 can be configured to dampen the downward movement of the lever.

As used herein, the "downward movement" of the lever 90 corresponds to the clockwise pivoting motion of the lever 90 about the pivot axis P defined by the pivot mechanism 62, as viewed in FIG. 3. This downward movement of the lever 90, i.e., clockwise pivot as viewed in FIG. 3 about the axis P corresponds to the movement of the lid 24 from the open position toward the closed position. As such, after a user releases the pedal 32 (FIG. 1 and FIG. 2) the damper mechanism 20 dampens the downward pivotal movement of the lever 90 and the lid 24.

The lid 24 and the pedal 32 can be biased toward the closed and resting positions, respectively, by way of any known device or configuration. For example, the weight of the lid 24 can be sufficient to move the lid 24 toward the closed position when nothing (other than gravity) is acting against the pedal 32. Optionally, springs can be added to the trashcan assembly 20, in any known configuration, to bias the lid 24 toward the closed position, and/or the pedal 32 to the resting position.

FIG. 3 also illustrates an optional stopper 140. The stopper 140 can be configured to define a limit of movement for the lever 90. For example, the stopper 140 can be configured to prevent the further downward pivoting of the lever 90 beyond a predetermined point.

Optionally, the stopper 140 can include an upper surface 142 positioned so as to press against a lower surface 144 of the lever 90. The position of the surface 142 can be arranged to stop the downward pivoting motion of the lever 90 as the lid 24 reaches its closed position.

In some embodiments, the stopper 140 can be positioned such that its uppermost surface is in a position in which the lower surface 144 of the lever 90 contacts the surface 142 just prior to the lid 24 reaching its fully closed position. As such, the stopper 140 can slow the closing movement of the lid 24 further and prevent the lid 24 from impacting the body 22 as it reaches its closed position. Further, in such a configuration, the stopper 140 can be made from soft and/or flexible materials such as foam rubber. Thus, the position of the stopper 140, its upper surface 142, and the material used to form the stopper 140 can be chosen to achieve the desired performance. In some embodiments, the stopper 140 is supported by the lower member 38 of the base 26. Additionally, in some embodiments, the damper 120 can be mounted to a portion of the support 68. FIG. 3 schematically illustrates the damper 120 being mounted to the support 68.

The positioning of the stopper 140 in the interior of the body 22 can provide further advantages. For example, when any of the moving components of the trash can 20 contact other components, there is the potential that such a contact can generate a noise. Thus, the lid 24 can generate noise when it contacts the upper support 38 or the liner 40 as the lid 24 reaches the closed position. Because the point of contact is also close to or at the boundary between the interior and exterior of the trash can 20, and because the lid is often the part of the trash can 20 that is the closest to the ears of a user, it is more likely that a noise generated by the lid 24 making contact with another component will be perceptible by the user.

Thus, by providing the stopper 140, or any other device configured to contact a moving component, in the interior of the trash can 20, any noise generated by contact between such internal components is less likely to be perceptible by the user. Additionally, by placing the stopper 140 near the bottom of the trash can 20, any noise generated by contacts is also less likely to be perceptible to a user. In operation, the stopper 140 can absorb some of the energy of the movement of the lid 24 toward its closed position, prior to the lid 24 reaching its closed position. This can also aid in reducing or eliminating noise that may be generated by the lid 24 reaching its closed position.

Figure 4:
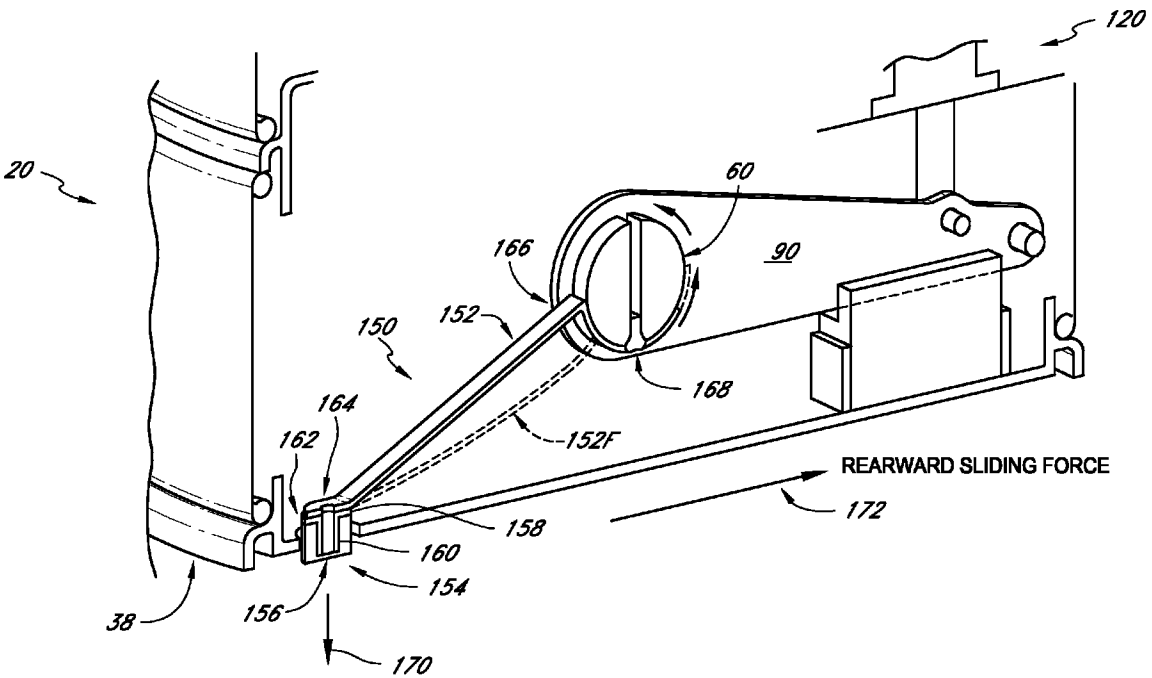
FIG. 4 is an enlarged, perspective, and partial sectional view of a modification of the embodiment illustrated in FIG. 3, including a mechanism designed to resist sliding of the receptacle during actuation of the pedal.

With reference to FIG. 4, the trashcan assembly 20 can also include an anti-sliding mechanism 150. The anti-sliding mechanism 150 can be configured to prevent or reduce a sliding motion caused by the forces generated when an operator depresses the pedal 32. In some embodiments, the anti-sliding mechanism 150 can be configured to increase an effective coefficient of friction between the trashcan assembly 20 and a surface upon which the trashcan 20 rests as the pedal 32 is moved from its resting position toward its actuating position.

For example, but without limitation, the anti-sliding mechanism 150 can be configured to convert the movement of the pedal 32, from its resting position toward its actuated position into a force pressing a friction member against the surface upon which the trashcan assembly 20 is resting. Such a surface can be, for example, but without limitation, vinyl flooring, wood flooring, carpeting, etc.

In some embodiments, as illustrated in FIG. 4, the anti-sliding mechanism includes an arm 152 connected to a friction device 154. The friction device 154 can be formed with any type of device that can generate friction at a contact patch between itself and the types of surfaces commonly found in homes, noted above, such as vinyl flooring, wood flooring, carpeting, etc.

In some embodiments, the friction device 154 can include a contact member 156 made of any rubber, or other material. Further, the contact member 156 can be made of a material or can include a surface texture that generates coefficients of friction with the typical flooring materials that are greater than the coefficients of friction between the other projections on the bottom of the base 26 and those types of flooring materials.

For example, as noted above, the base 38 can include projections in the form wheels, casters, gliders, and/or other extensions that together support trash can 20 in a stable and upright position on a surface, such as those flooring material surfaces noted above. Thus, the friction device 154 can include at least a portion (e.g., the contact member 156) made from a material or including a surface texture that provides a greater coefficient of friction with the typical flooring materials than the coefficient of friction between the other projections. In embodiments where there are a plurality of different projections on the bottom of the trash can assembly 20, an effective coefficient of friction of the combination of those projections and each flooring material can be determined experimentally, based on the resistance of the trashcan 20 against sliding along each of the different surfaces.

In some embodiments, the contact member can include an engagement member 158 configured to provide engagement between the contact member 156 and the arm 152. In some embodiments, the engagement member 158 can include a shaft portion 160 extending into a central portion of the contact member 156 and an upper flange portion 162. The upper flange portion 162 can be connected to a distal end 164 of the arm 152. However, other configurations can also be used A proximal end 166 of the arm 152 can be connected to the pedal 32, the lever 90, or the pivot mechanism 60. In the illustrated sectional view of FIG. 4, the proximal end 166 of the arm 152 is attached to a portion of the pivot mechanism 60. In the illustrated embodiment, this portion of the pivot mechanism 60 has a round outer surface.

The proximal end 166 of the arm 152 extends around a portion of the periphery of the pivot mechanism 60. Additionally, a screw 168 secures the proximal end 166 of the arm 152 to the pivot mechanism 60. The illustrated portion of the pivot mechanism 60 pivots with the lever 90 and the pedal 32 during operation.

Thus, with continued reference to FIG. 4, during operation, when the pedal 32 is moved downwardly from its resting position to its actuated position, the pivot mechanism 60 pivots in a counterclockwise direction (as viewed in FIG. 4). As such, the proximal portion 166 of the arm 152 is also pivoted in the same direction. However, because the distal end 164 of the arm 152 is attached to the contact member 156, which is positioned to contact the surface upon which the trashcan assembly 20 sits, the arm 152 is bent into the configuration illustrated in phantom line and identified by the reference numeral 152F. As such, this flexation of the arm 152 generates a downward force identified by the arrow 170. This downward force transfers some or all of the normal force created by the weight of the trashcan assembly 20 and the downward pressing of the pedal 32 by the user, to the contact member 156, thereby raising the coefficient friction existing between the trashcan assembly 20 and the surface which the contact member 156 contacts, i.e., the surface upon which the trashcan assembly 20 rests. This is because, as noted above, the contact member can be configured, by way of the material used to form the outer surface of the contact member 156 or the surface texture of the contact member 156 to have a greater coefficient of friction (with a flooring surface) than that of the other projections on the bottom of the base 38.

With reference again to FIG. 1, when a user depresses the pedal 32 with their foot, occasionally, a user can also push against the pedal 32 generating a rearward sliding force identified by the arrow 172 in FIG. 4. Thus, by providing the anti-sliding mechanism 150, an additional friction or "anti-sliding" force can be generated between the contact member 156 and the surface upon which the trashcan assembly 20 rests, to thereby prevent or reduce the rearward sliding motion of the trashcan assembly 20. In some embodiments, the arm 152 is made from a spring steel. However, other materials can be used. Additionally, the shape and configuration of the anti-sliding mechanism 150 can be designed, by one of ordinary skill in the art, to provide the desired amount of friction.

With reference to FIGS. 5-8, the damper mechanism 120 can be a fluid type damper operating with air as the working fluid. In the illustrated embodiment, the damper mechanism 120 can include a housing 200. The housing 200 can be mounted anywhere the trashcan assembly 20. In some embodiments, as illustrated schematically in FIG. 3, the housing 200 of the damper mechanism 120 can be mounted to the support member 68 of the base 26.

The housing 200 can define a cylinder in which a damper piston 202 can reciprocate. The dampening function of the dampening mechanism 120 is achieved by way of the resistance of the flow of a fluid, such as air, into and out of the housing 200. This can generate sufficient damping forces for slowing the closing of the lid 24. Such forces can be large.

The piston 202 can include a piston head 203 and a piston rod extending from the piston head 203 and outwardly from a lower end of the housing 200. The piston rod 205 can include an aperture 207 configured to allow the piston rod 205 to be pivotally connected to another member, such as the rod 132 or another member.

Figure 5:
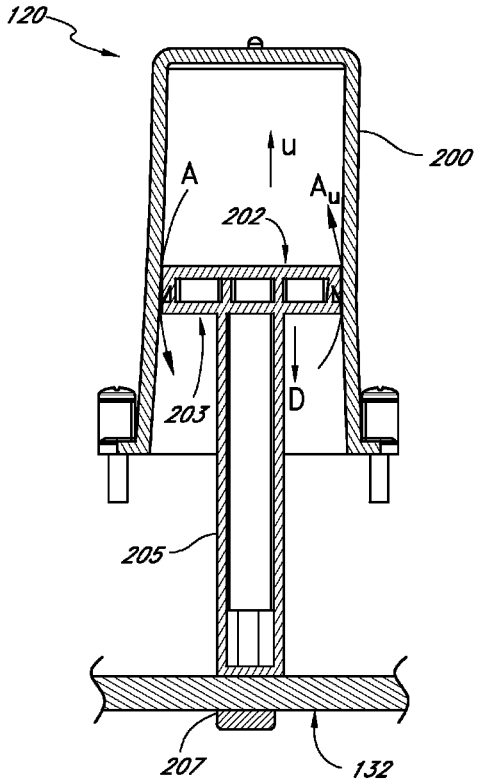
FIG. 5 is an enlarged sectional view of a damper mechanism that can be used with the receptacle illustrated in FIG. 1.

With continued reference to FIG. 5, when the pedal 32 (FIG. 1) is pressed toward the open position, the piston 202 inside the damper housing 200 is moved toward its uppermost position. With reference to FIG. 2, in the open position, the members 102, 104 hold the lid 24 toward in the open position, and the rear ends 98, 100 of the levers 90, 92 are also raised with respect to the foot pedal 32. When the rear of the levers 90, 92 are raised, the piston 202 is pushed upwardly inside the damper housing 200 by way of its connection to the lever 90, to the uppermost position illustrated in FIG. 8.

When the force on the pedal 32 is released, the combined forces from the weight of the lid 24 (if applicable), the weight of other components connected to the lid 24 and/or other biasing devices configured to bias the lid 24 toward the closed position, push the members 102, 104 downwardly. As the members 102, 104 move downwardly, they push the rear ends of the levers 90, 92 downwardly, thereby pulling the piston 202 downwardly within the housing 200 (FIG. 5). However, the relative pressure between the atmosphere acting on the bottom of the piston 202 and the air trapped between the top of the piston 202 and the top of the housing 200 opposes the immediate downward motion of the piston 202 as the piston begins to move downwardly, and thus opposes the downward motion of the rear ends of the levers 90, 92, and thus opposes the downward motion of the lid 24 toward its closed position.

In some embodiments, the piston 202 can be configured to provide less resistance to the upward movement of the piston 202 within the housing 200 but provide greater resistance against the downward movement of the piston 202 within the housing 200. This can be accomplished in any known manner.

Figure 6:
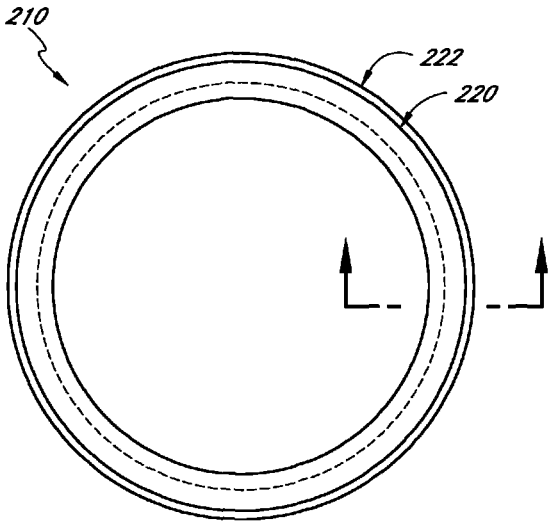
FIG. 6 is a top plan view of a lip seal that can be used with a damper illustrated in FIG. 5.
Figure 7:
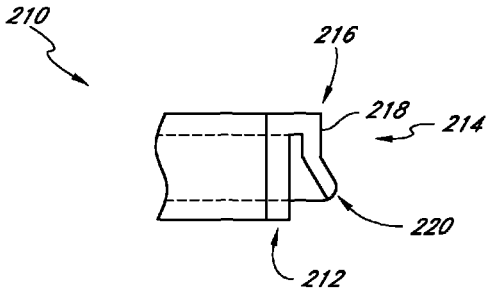
FIG. 7 is a sectional view of the lip seal of FIG. 6 taken along line 7-7 of FIG. 6 taken along line 7-7 of FIG. 6.

In the illustrated embodiment, and with additional reference to FIGS. 6 and 7, the piston 202 can be provided with a lip seal 210. In some embodiments, the lip seal 210 can be configured to operate similarly to a check valve. Thus, the lip seal 210 can have any configuration that can provide a similar function.

In the illustrated embodiment, the lip seal 210 is generally annular in shape, having an inner wall 212 and an outer wall 214 connected by a top wall 216. The outer wall 214 can include an upper portion 218 that extends generally parallel to the inner wall 212 and a projecting portion 220 that is biased to extend radially outwardly relative to the upper portion 218. As such, the outer diameter 220 defined by the upper portion 218 is slightly smaller than the diameter 222 defined by the projecting portion 220. Additionally, the ramped configuration of the projecting portion 220 (when in a relaxed state) relative to the upper portion 218 helps to achieve the check valve type functionality of the lip seal 210.

For example, with reference to FIG. 5, as the piston 202 moves upwardly within the housing 200 in the direction of arrow U, air A flows downwardly along the inner walls of the housing 200, past the projecting portion 220 of the lip seal 210. Due to the ramped shape of the projecting portion 220, the pressure generated within the upper portion of the housing 200 above the piston 202 helps deflect the projecting portion 220 radially inwardly, thereby allowing the air A to pass thereby without generating a larger resistance.

However, when the piston 202 moves downwardly within the housing 200, the air pressure in the space above the piston 202 drops relative to the pressure of the atmosphere, thereby causing the projecting portion 220 to further expand against the inner walls of the housing 200. This generates additional resistance to the flow of air k into the space above the piston 202. As such, the lip seal 210 generates more resistance to the downward movement of the piston 202 than against the upward movement of the piston 202.

In some embodiments, the lip seal 210 can be lubricated with graphite powder. Such lubrication with graphite powder and the construction of dampers, which can be applied to the present dampers 120, 122, are disclosed in U.S. Pat. Nos. 6,513,811 and 6,726,219, the entire contents of both of which, including the specific portions including the descriptions of damper design and lubrication with graphite powder, are hereby incorporated by reference. Additionally, the size of the dampening mechanism 120 can be chosen by the designer to provide the desired functionality and performance.

Figure 8:
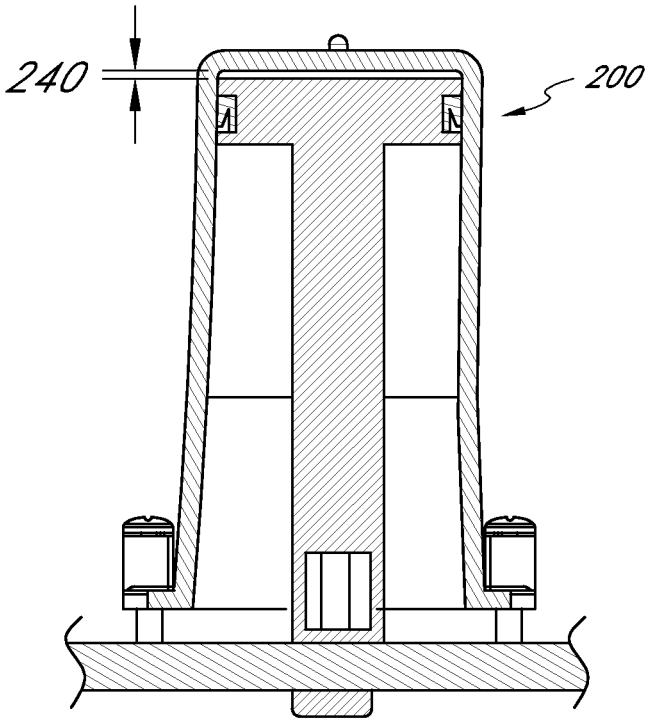
FIG. 8 is a sectional view of the damper mechanism of FIG. 5 in a position corresponding to when the lid is opened to its maximum opened position.

For example, with reference to FIG. 8, the height of the housing 200, which determines the length of the maximum vertical movement of the piston 202 within the housing 200, can be chosen to accommodate the maximum vertical displacement of the point at which the dampening mechanism 120 is attached to the lever 90 (FIG. 3). Additionally, the diameter of the housing 200 and the type of lip seal 210 used affects the resistance generating during the downward movement of the piston 202. Thus, these dimensions can be chosen to provide the desired dampening characteristics.

Further advantages can also be achieved where the size of the housing 200 and the position at which the housing 200 is mounted within the assembly 20 can be adjusted to provide desired characteristics of the motion of the lid 24 during its closing movement. For example, it has been found that if the housing 200 is mounted in a position where the piston 202 is spaced excessively far from the top of the housing 200 when the piston 202 is at its maximum vertical position, the lid 24 can initially move too quickly from its fully opened position toward its closed position. Such an initial quick movement can cause the lid 24 to bounce during its downward movement.

However, if the mounting position of the housing 200 is adjusted so that the piston 202 is closely spaced relative to the top of the housing 200 when the piston 202 is at its maximum upper position (FIG. 8), the damper provides additional dampening, at least initially, thereby providing a slower, more aesthetically pleasing motion.

For example, by adjusting the position of the housing 200 such that a spacing between the piston 202 and the top of the housing 200 when the piston 202 is at its maximum position, when the foot pedal 32 is released, the lid 24 can begin to move very slowly initially, and slowly accelerate to an acceptably slow closing speed, such that the lid 24 does not make an excessive loud noise when it finally comes to rest against the support 38. In some embodiments, the spacing 240 can be equal to or less than about 10% of the total movement of the piston 202. The initial movement of the piston 202 is further slowed at the spacing 240 is about 5% or less of the total movement of the piston 202. Finally, mounting the housing 200 such that the spacing is about 4% or less of the total movement of the piston 202 provides further slowing, and thus achieves a more aesthetically pleasing movement.

A designer can choose the appropriate housing, piston, and lip seal combination to achieve the desired closing speed. Thus, in some embodiments, at least one of the lid 24, housing 200, piston 202, lip seal 210, pedal 32, and position of the pivot mechanism 62, 64 can be configured to achieve the desired closing speed. In some embodiments, for example, but without limitation, the above parameters can be chosen to achieve a closing speed of the lid of about 5 seconds from the moment a user removes their foot from the pedal 32.

With reference again to FIG. 2, the dampening mechanism 122 can be constructed and attached to the lever 92 in the same manner that the dampening mechanism 120 is attached to the lever 90. Additionally, the dampening mechanism 122 can be configured to provide approximately the same dampening performance as the dampening mechanism 120.

Thus, when the pedal 32 is actuated by a user, for example, when a user steps on the pedal 32 to move the pedal 32 from its resting position, pivoting downwardly toward its actuated position, the pistons within the dampening mechanisms 120, 122 are moved to their respective uppermost positions. During this motion, due to the arrangement of the lip seals 210 in each of these dampening mechanisms 120, 122, the dampening mechanisms 120, 122 provide little resistance to this opening motion. However, when the pedal is released by the user, the dampening mechanisms 120, 122 provide essentially the same dampening forces against the movement of the levers 90, 92. Thus, the dampening forces are applied more equally and more balanced to the pedal 32. As such, the movement of the pedal 32 from its actuated position back towards it resting position is more uniformed and is less likely to allow the pedal 32 to remain in a position that is twisted relative to the body 22.

Figure 9:
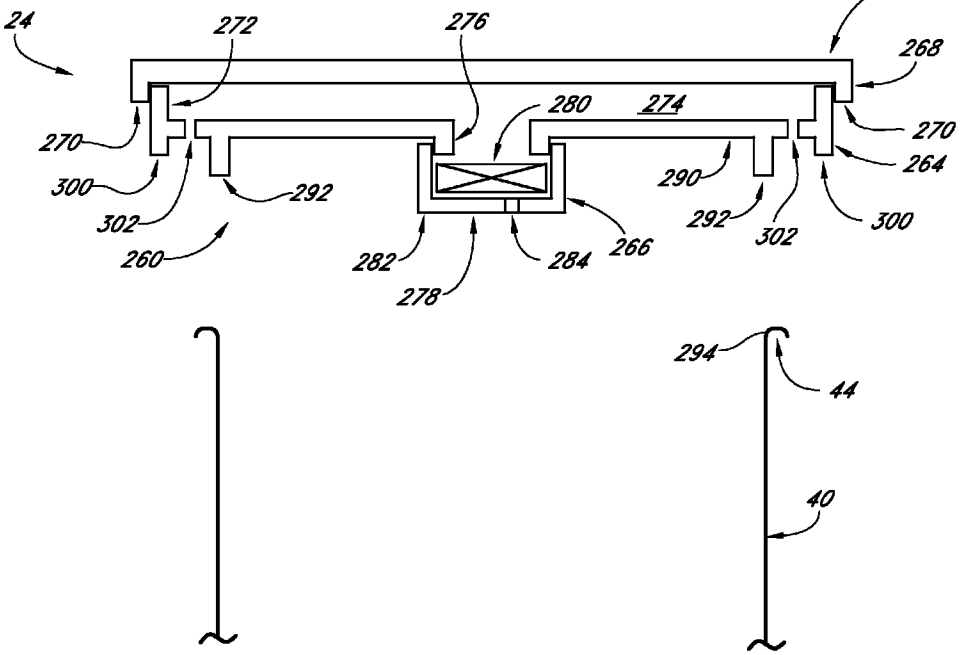
FIG. 9 is a schematic illustration of an air filtration device that can be used with the trashcan of FIG. 1, which includes an air guide assembly mounted to an interior side of the lid of the trashcan.

With reference to FIG. 1, the lid 24 can also include a filtration mechanism 260. FIG. 9 is a schematic representation of the air filtration device 260, which is incorporated into the lid 24 in the illustrated embodiment.

As schematically shown in FIG. 9, the lid can include an outer lid member 262, an air guide 264 and a filter holder 266. The outer lid member 262 can be formed in any known manner. In some embodiments, the outer lid member 262 is formed from a piece of sheet metal, such as stainless steel. However, other materials can also be used. In the illustrated embodiment, the outer lid member 262 is solid and does not include any air holes. However, other configurations can also be used in which the outer lid member 262 includes air holes, and/or other features.

As shown in FIG. 9, an outer periphery 268 of the outer lid member 262 includes a shoulder 270. In the illustrated embodiment, the shoulder 270 extends downwardly from the outer periphery 268 of the outer lid member 262.

The air guide 264 can include an upper outer peripheral shoulder 272. In the illustrated embodiment, the upper outer peripheral shoulder 272 extends around the entire periphery of the air guide 264. Additionally, the outer surface of the upper outer peripheral shoulder 272 is configured to sit within the shoulder 270 of the outer lid member 262.

In some embodiments, the fit between the upper outer shoulder 272 and the shoulder 270 can form a generally air resistant seal. However, it is not necessary for the shoulder 272 and the shoulder 270 to form an air resistant seal. The contact and or close spacing between the shoulders 272, 270 can be sufficiently continuous to significantly resist the flow of air therebetween. Additionally, in some embodiments, an adhesive or other sealant can be used to form a seal between the shoulders 270, 272. With the air guide 264 fit with the outer lid member 262, a space 274 between the outer lid member 262 and the air guide 264.

The air guide 264 can also include an inner aperture 276. Additionally, the air guide 264 can include a filtration device 278 fit over the aperture 276. In some embodiments, the filtration device 278 can include an filter member 280 and a filter housing 282.

The filter member 280 can be any type of known filter device, such as those including activated charcoal. Preferably, the filter device 280 is configured to remove odors from air, such as those odors normally generated or discharged by common household trash.

The filter housing 282 can include an internal cavity designed to contain the filter device 280 and to seal against the aperture 276. Additionally, the cover 282 can include one or more apertures 284 configured to allow air to move from the exterior into the interior of the cover 282. Further, the cover 282 can be configured to form an additional seal around the periphery of the filter member 280 such that air entering the aperture 284 through the cover 282 will pass through the filter 280 before passing to the space 274. The movement of the air in such a manner is described in greater detail below.

A lower surface 290 of the air guide 264 can include an additional inner peripheral shoulder 292. The inner peripheral shoulder 292 can be configured to define an outer peripheral shape that is complementary to an inner peripheral shape of an upper end 294 of the liner 40. As such, when the lid 24 moves toward its closed position, the shoulder 292 can move into close proximity and/or make contact with the inner peripheral surface 294 of the liner 40. This can help in guiding the air from the interior of the trashcan assembly 20, into the filtration device 266, into the space 274, described in greater detail below. This close proximity or contact between the shoulder 292 and the inner peripheral surface 294 can also form an air resistant seal when the lid 24 is in its fully closed position, which can further aid in guiding the air from the interior of the trashcan assembly 20, into the filtration device 266, into the space 274.

The air guide 264 can also include an outer downwardly extending shoulder 300. The outer downwardly extending shoulder 300 can extend around the entire periphery of the air guide 264. Additionally, the outer downwardly extending peripheral shoulder 300 can be sized and shape to move into close proximity and/or make contact with the upwardly extending wall 50 (FIG. 1) of the upper support 38, and in some embodiments, form an air resistant seal. The air guide 264 can also include apertures 302 disposed outwardly from the shoulder 292

During operation, for example, as the lid 24 moves from its open position toward its closed position, a slight compression of the air within the liner 40 can be generated. For example, when the lid 24 is in its open position, the air within the liner 40, existing within and above any trash that may be contained in the liner 40, is at atmospheric pressure. However, as the lid 24 pivots downwardly toward its closed position, and as the various shoulders at the periphery of the lid 24 come into the vicinity of corresponding shoulders and surfaces on the body 22, a positive air pressure can be created within the liner 40. On known trashcan designs with flat lids, this would typically cause a puff of air to be discharged from the interior of the trashcan assembly 20. If the air within such a trashcan contains strong odors, such odors would be pushed out into the room in which such a trashcan is positioned and likely toward a user of such a trashcan.

Figure 10:
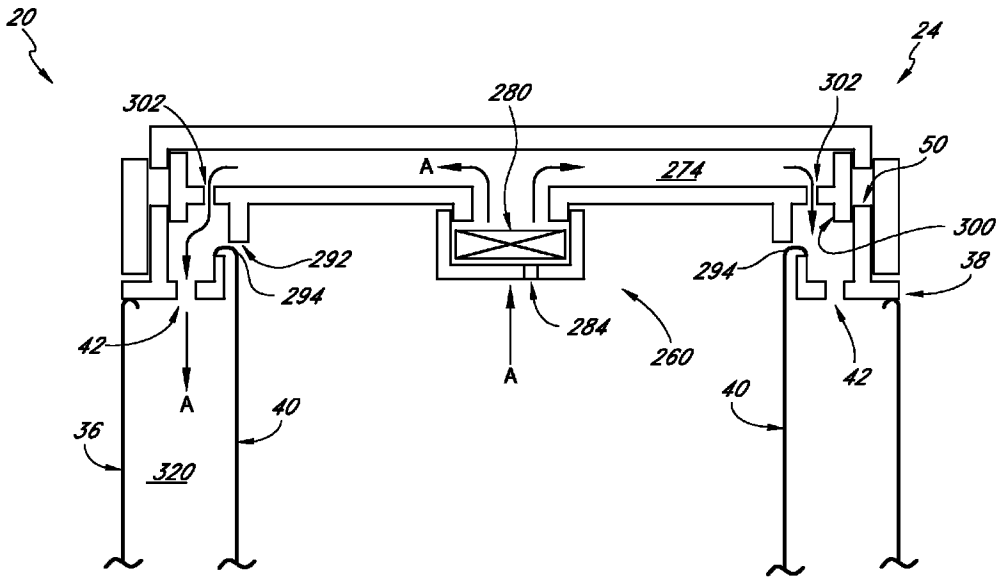
FIG. 10 is a further schematic illustration of the air filtration device illustrated in FIG. 9, showing the lid in a position close to a fully closed position.

With reference to FIG. 10, the trashcan assembly 20 can be configured to use this momentary pulse of air to help guide air through the filtration device 260.

For example, as illustrated in FIG. 10, as the lid 24 approaches its closed position, the shoulder 292 of the air guide comes into close proximity and/or into contact with the upper inner peripheral surface 294 of the liner 40. Thus, air A within the liner 40 is trapped except for the apertures 284. Thus, as the pressure within the liner 40 rises during this downward movement of the lid 24, air A, due to its positive pressurization within the liner 40, is pushed through the apertures 284, and through the filter element 280 into the space 274. As such, the odors from the air can be removed by the filter element 280.

As noted above, the air guide 264 also includes apertures 302 disposed outwardly from the shoulder 292. Thus, the air A flowing through the apertures 284 and the filter member 280 can continue to flow through the space 274 and out of the space 274 through the apertures 302.

In some embodiments, a trashcan assembly 20 can be configured to allow the air passing through the apertures 302 to be discharged directly to the atmosphere. For example, the shoulder 300 can be provided with apertures.

However, further advantages can be achieved if the air filtration device 260 is configured to guide the air which has moved through the filter element 280 into a further interior compartment of the trashcan assembly 20, for example, between the shell 36 and the liner 40.

As noted above, the lower outer peripheral shoulder 300 of the air guide 264 can be configured to move into close proximity and/or contact with the upwardly standing wall 50 of the upper support 38. As such, as the lid 24 moves downwardly toward its closed position, the shoulder 300 can form a seal and/or an area of higher resistance to airflow. As such, air A flowing through the space 274 can exit the space 274 through the aperture 302, and then apertures 42 disposed in the upper support member 38 (described above with reference to FIG. 1).

The space between the shell 36 and the liner 40, identified by the reference numeral 320, can be open to the atmosphere. For example, this space 320 can be open to the atmosphere through various holes in the base 26. For example, the base 26 can include a plurality of various holes and apertures in the support plate 38 (as illustrated in FIG. 2). Additionally, the shell 36 can include an aperture 321 (FIG. 2) configured to perform as a handle for carrying the trashcan 20, and/or other apertures can also be provided.

Thus, as the lid 24 closes, air A can be pumped from the interior of the liner 40, through the filter element 280, and into the space 274, and the air A can be further pumped or urged downwardly into the interior of the trashcan assembly 20, such as the space 320 between the liner 40 and the shell 36. This can provide a further advantage in that the user experiences a smaller or no puff of air as the lid 24 closes. Additionally, if the user has not inserted a filter element 280 into air filtration device 260, or if the air filter element 280 has exceeded its useful lifespan, and can no longer remove odors from the air A, the user is not subjected to a puff of air filled with trash odors. Rather, this odor filled air is pumped downwardly into the interior of the trashcan and leaks out in various places near the base or other apertures. Thus, even when the air filtration device does not filter any odors from the air, it directs the "puff" of air into the interior of the body 22, thereby deflecting at least some of that flow of air away from the user.

FIGS. 1, 2, 11 and 12 illustrate a modification of the air filtration device illustrated in FIGS. 9 and 10. Thus, the air filtration device illustrated in FIGS. 11 and 12, along with its components corresponding to that of FIGS. 9 and 10, are identified with the same reference numerals A except that a letter "A" has been added thereto. Thus, the construction and operation, and effects of the components described above apply to the device 260A described below, except as specifically noted below.

Figure 11:
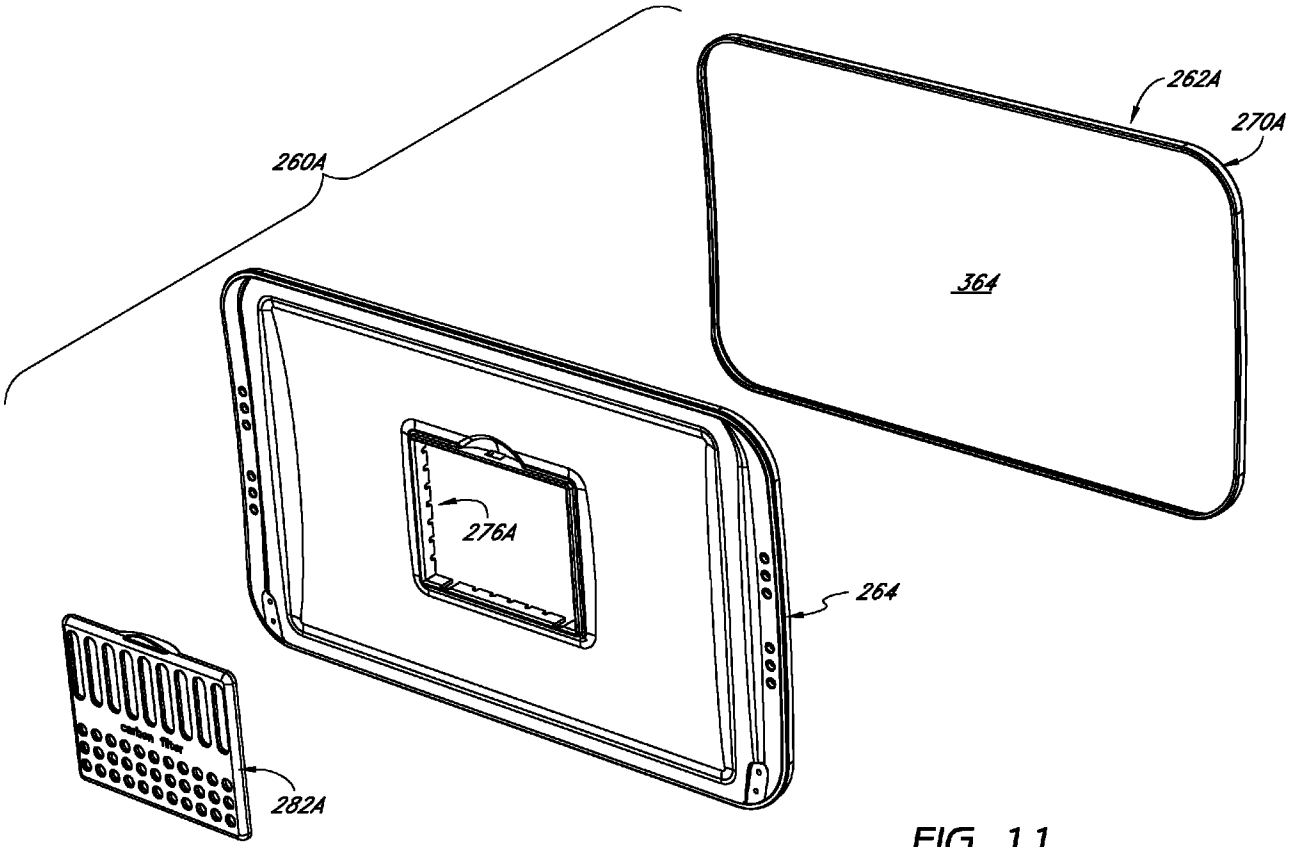
FIG. 11 is an exploded view of another embodiment of the air filtration device illustrated in FIGS. 9 and 10.

As shown in FIG. 11, the cover 282A includes an upper peripheral edge 360, having an outer dimension that is smaller than inner dimension of the aperture 276A of the air guide 264A. As such, the cover 282A generally fits within the aperture 276A.

Figure 12:
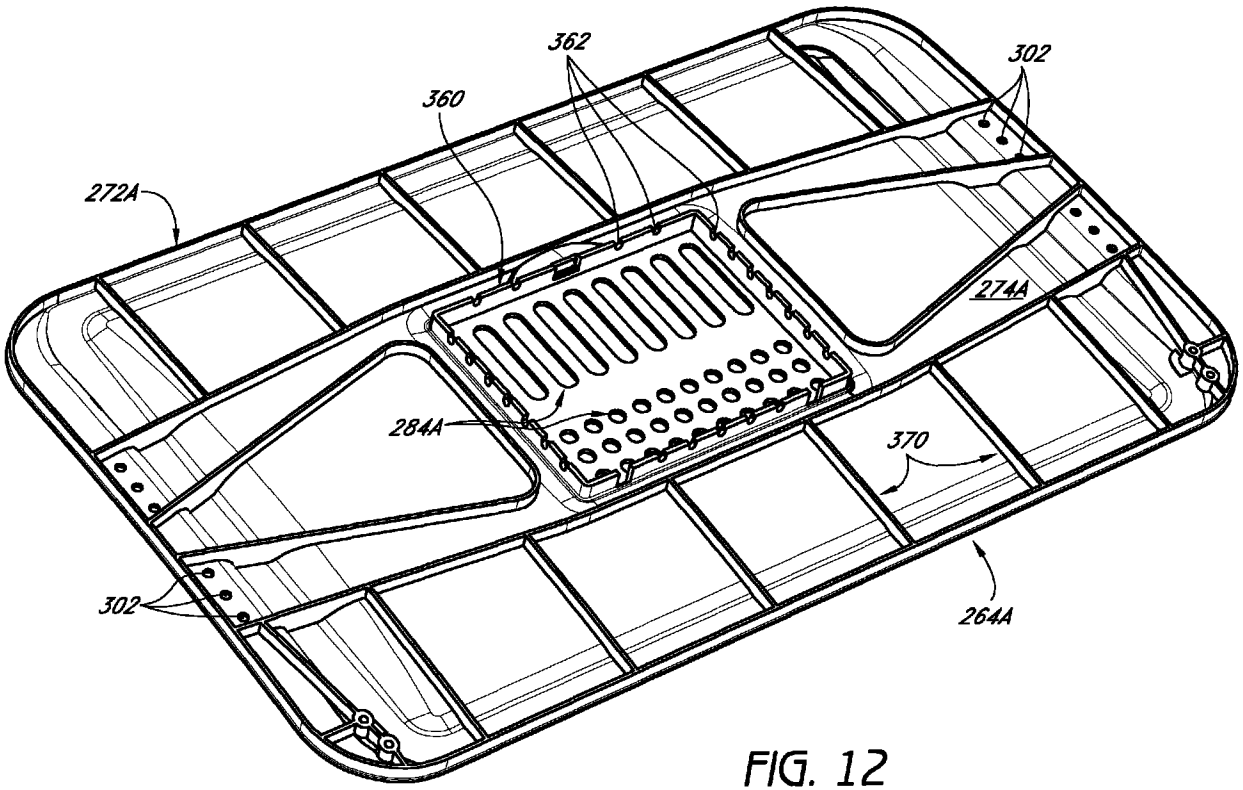
FIG. 12 is a perspective view of an inner surface of a portion of the air filtration mechanism illustrated in FIGS. 9 and 10.

With reference to FIG. 12, the edge 360 can include a plurality of apertures or notches 362. As such, when the cover 282A is inserted into the aperture 276A, it may make contact with an inner surface 364 of the outer lid member 262A. Thus, the notches 362 allow air to flow outwardly into the space 274A even if the cover 282A makes contact with the inner surface 364. Other configurations can also be used. For example, the notches 362 can be provided in a wall fixed to the air guide 264 and the removable portion of the cover can attach to a periphery of the aperture 276A.

Additionally, with continued reference to FIG. 12, the air guide 264A can include a plurality of stiffening ribs 370 extending from the outer peripheral shoulder 272 inwardly toward the aperture 276A. This provides an additional benefit in that when the lid is closed and air is pumped into the space 274A, the surface of the air guide 264A surrounding the aperture 276A can be subjected to forces that would tend to deflect the surface of the air guide 264A due to the positive pressure within the liner 40. Similarly, as the lid 24 is opened, a slight vacuum can be created within the liner 40, thereby causing the surfaces of the air guide 264A surrounding the aperture 276A to tend to deflect toward the interior of the liner 40. These movements of the surfaces can cause failures and/or noises within the trashcan assembly 20A. Thus, the stiffening ribs 370 help reduce or prevent such noises or failures.

Figure 13:
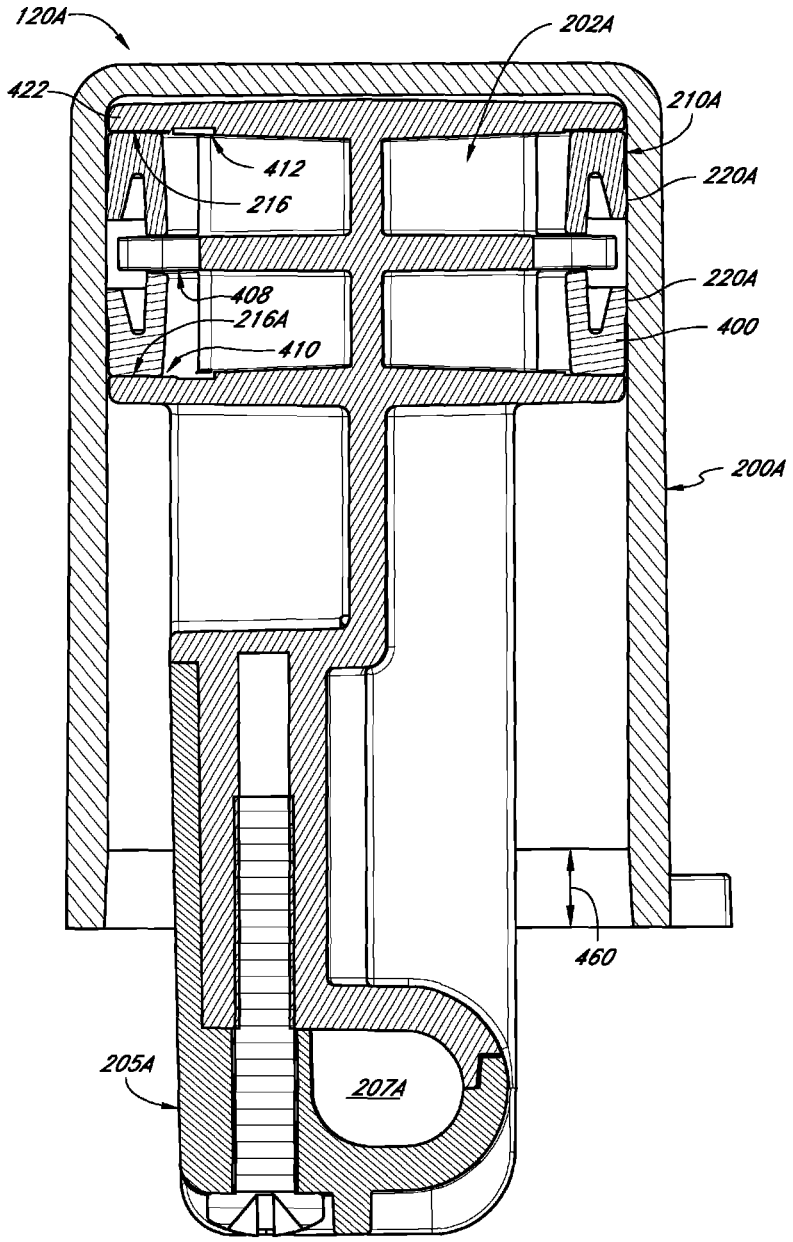
FIG. 13 is a sectional view of a modification of the air damper mechanism of FIG. 5.
Figure 14:
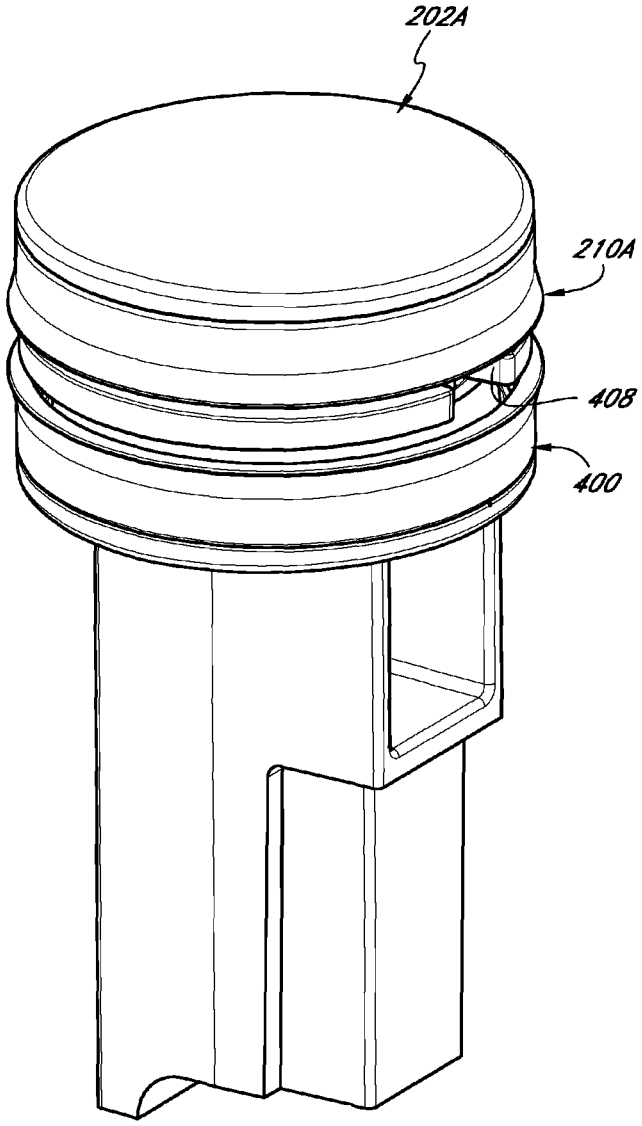
FIG. 14 is an illustration of a piston of the air damper mechanism of FIG. 13.
Figure 15:
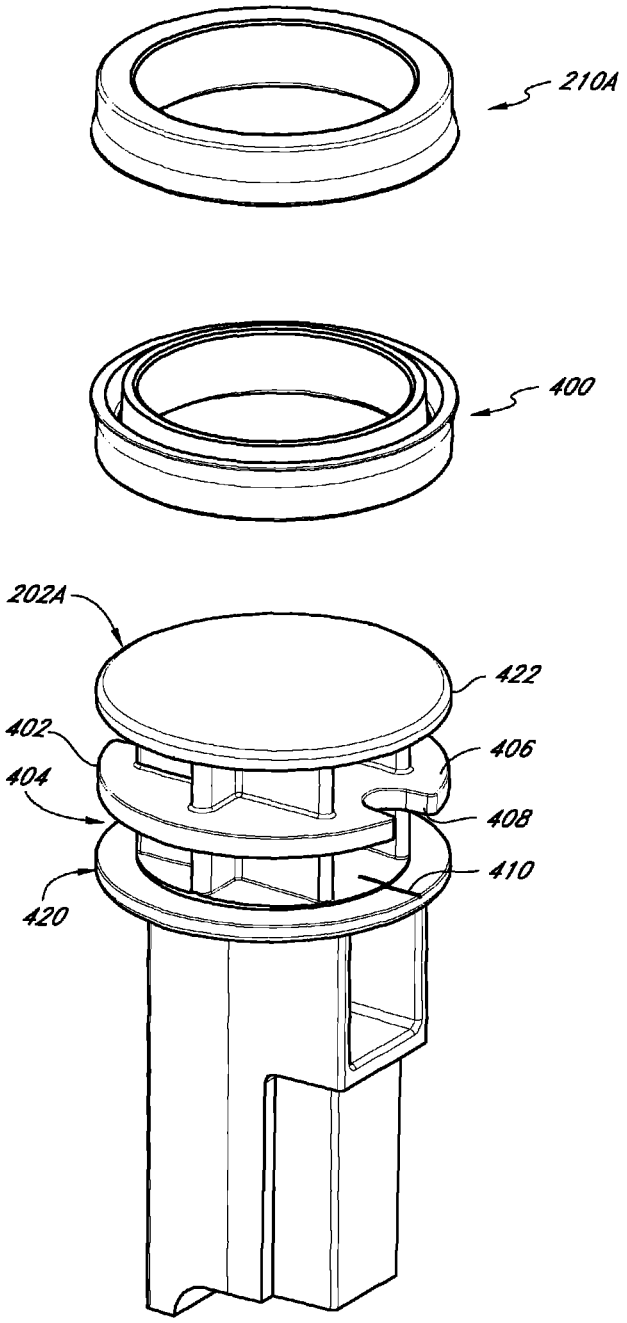
FIG. 15 is an exploded view of the piston of FIG. 14.

With reference to FIGS. 13-15, the trashcan receptacle 20 can be provided with at least one dampening mechanism configured to provide dampening against the movement of the lid 24 in both the opening and closing directions. Such a dampening mechanism can be constructed in any known manner. By providing dampening in both the opening and closing directions, the trashcan 20 can avoid certain additional undesirable noises and/or damage.

For example, a user may intentionally or accidentally step on the pedal 32 with significantly more force than necessary to open a lid 24. This can cause a lid 24 to open at a great speed, and thereby raise the possibility that the lid 24 impacts a wall or another nearby body. Such an impact can cause a large noise. Additionally, such a movement of the lid 24 can damage the hinge mechanism connecting lid 24 to the body 22.

The dampening mechanism 120A illustrated in FIGS. 13-15 is a modification of the dampening mechanisms 120, 122 described above with reference to FIGS. 2 and 5-8. Thus, the dampening mechanism 120A of FIGS. 13-15 is identified by the same reference numeral, except that a capital letter "A" has been added thereto. Thus, the corresponding components can be constructed and operated in the same way as described above, except as specifically described below.

As illustrated in FIGS. 13 and 14, the dampening mechanism 120A includes two lip seals 210A and 400. The lip seal 400 can be constructed in the same manner as lip seal 210A. In other embodiments, the lip seal 400 can be different from the lip seal 210A, for example, if it is desired to provide different dampening performance against the upward motion of the piston than the downward motion of the piston. However, for convenience, the same reference numerals used to identify various parts of the lip seal 210A are used to identify the same or similar parts of the lip seal 400. Thus the configuration of the lip seal 400 can be the same or similar to the lip seal 210A, except as noted below.

With reference to FIGS. 14 and 15, the piston 202A includes two peripheral grooves 402, 404 sized and shaped to retain the lip seals 210A, 400, respectively. A disk-shaped wall 406 can be disposed between the grooves 402, 404, and thus between the lip seals 210A, 400. As illustrated in FIG. 15, the disk 406 includes a large aperture 408 which allows for airflow between the lip seals 210A, 400, described in greater detail below.

With such a configuration, as noted above, the lip seal 210A resists the downward movement of the piston 202A while the second lip seal 400 resists the upward movement of the piston 202A. As noted above, with regard to this description of the lip seal 210, the various parts of the lip seals 210A, 400, the lubrication used, etc., can be adjusted to provide the desired dampening characteristics.

Further advantages, including greater consistency in performance, can be achieved by providing the dampening mechanism 120A with at least one metering channel 410, 412, to allow air to leak around at least one of the lip seals 210, 400.

For example, with reference to FIG. 15, the piston 202A includes a lower wall 420 cooperating with the central disk 406 to define the channel 404. Additionally, the piston 202A includes an upper wall 422 cooperating with the disk 406 to define the channel 402. However, other configurations can also be used.

As shown in FIG. 13, the upper wall 216A of the lip seal 210A rests against the downwardly facing surface of the upper wall 422. Similarly, the upper wall 216A of the lip seal 400 rests against the upwardly facing wall of the lower wall 420. Across the contact patch between the upper wall 216A and the downwardly facing surface of the upper wall 422, the metering channel 412 extends so as to allow airflow between the exterior of the piston, and the space above the top of the piston 202A and the interior of the piston 202A. Similarly, the metering channel 410 allows the flow of air from the exterior of the piston, beneath the upper wall 416A, of the lip seal 400, and into the interior of the piston.

Additionally, as noted above, the central disk 406 includes an aperture or notch 408 thus, air can leak from the atmosphere, beneath the wall 216A of the lip seal 400, into the interior of the piston, upwardly through the notch 408, into the metering channel 412, then outwardly above the wall 216A of the lip seal 210A, and into the space within the housing 200A above the top of the piston 202A. As such, the metering channels 410, 412 can limit the amount of dampening generated by the lip seals 210A, 400.

In an exemplary but nonlimiting embodiment, the housing 200A can be made from a material commercially available under the trade name Acetal Delrin with 10% Teflon added. The piston 202A can also be made from the material known as Acetal Delrin. Further, the lip seal 210A, 400 can be made from graphite impregnated nitrile. Other materials can also be used.

Further, in some examples, the metering channels 410, 412 can have a width of approximately 0.15 mm and a depth of approximately 0.15 mm. Additionally, depending on the performance desired, a plurality of metering channels 410, 412, can be provided on each of the walls 420, 422.

Additional advantages can be achieved by providing the dampening mechanism 120A with the ability to provide variable dampening in at least one of its directions of movement. For example, when a user initially steps on the pedal 32 of the trashcan assembly 20, the lip seal 400 will oppose the upward movement of the piston 202A within the housing 200A due to its inverted orientation relative to the lip seal 210A. This will help prevent an excessively fast opening speed of the lid 24.

Further, it has been found that it can be advantageous to provide a reduced dampening force against the initial movement of the pedal 32 toward its opening position. For example, with regard to some trashcans, such as a trashcan assembly 20 illustrated in FIG. 1, due to the pivoting arrangement of the lid 24, a user must apply the most amount of force to move the pedal 32 when the lid 24 is closed, as compared to the forces required to move the pedal 32 through the remainder of its opening motion. This is because when the lid 24 is orientated in its closed position, the weight of the lid 24, acting at its center of gravity, provides the largest torque against the pivoting movement of the lid 24 towards it open position. Thus, the force required to move the pedal 32 through its initial portion of its movement toward its opening position is greatest when the lid 24 is closed.

However, in operation, as the lid 24 pivots toward its open position, the horizontal position of the center of gravity moves closer to the pivot axis, and thus, the torque generated by the weight of the lid 24 decreases proportionally. As the center of gravity of the lid 24 moves directly over the pivot axis, the torque created by the weight of the lid falls to zero. Thus, as the lid 24 pivots toward its open position, depending on the force applied to the pedal, the lid can achieve an excessive angular velocity and thus an excessive angular momentum. This can result in damage to the lid 24, a hinge connecting the lid 24 to the trashcan assembly 20, a nearby wall, or other damage.

Further, if a trashcan includes a feature, such as a filtration device, which may generate a vacuum during the initial opening movement of the lid, the force required to move the pedal 32 from its initial resting position can be even greater due to the additional weight to the filtration device. Thus, it can be advantageous to provide a dampening mechanism that can reduce the initial dampening forces applied during the initial movement of the lid toward its opening position. Such a reduction in the initial movement of a pedal can be achieved through any known device, including, for example, but without limitation, lost motion devices, the sizing and configuration of the dampening device itself, and/or other devices.

With continued reference to FIGS. 13-15, the dampening mechanism 120A can be configured to provide a variable or changing dampening force over the range of motion of the piston 202A relative to the housing 200A in at least one direction.

In some embodiments, this variable dampening can be provided by providing the housing 200A with a zone 460 having a greater inner diameter than the remainder of the housing 200A. Additionally, the housing 200A and the connection of the piston 202A with the member 102 can be arranged such that the outer projection 220A of the lip seal 400 contacts the inner surface of the housing 200A in the zone 460 when the pedal 32 is in its resting position.

For example, but without limitation, the inner diameter of a portion of the zone 460 can be sufficiently greater than the remaining inner diameter of the housing 200A, that the projection 220A of the lip seal 400 loses contact with at least a portion of the inner surface of the zone 460. Thus, when the pedal 32 is depressed by a user, initially, the lip seal 400 generates greatly reduced or no dampening force against the upward movement of the piston 202A within the housing 200A. In some embodiments, the increase in diameter of the inner surface of the housing 200A in the zone 460 is gradual. Thus, as the projection 220A of the lip seal 400 moves from the lowest portion (as viewed in FIG. 13) of the zone 460, upwardly, the projection 220A will remain oriented in the desired position, gradually regain contact with the inner surface of the housing 200A and generate dampening force as it leaves the zone 460.

In some embodiments, the zone 460 can have the same diameter as the other parts of the inner surface of the housing 410, and the damper 120A can be configured to provide reduced dampening against the opening movement of the lid 24 with other techniques. For example, the overall size and/or proportions, including for example, but without limitation, the total volume of the housings 200, 400, the stroke (i.e. the total distance the pistons 202, 202A travel within the corresponding housing), the ratio of the stroke to the diameter of the housing, the compressibility of the working fluid (e.g., air and other gasses are "compressible fluids" and most liquids are "non-compressible"), can affect the dampening provided during the initial movement of the lid 24 toward the open position. Thus, in some configurations, one of these parameters can be determined to provide the desired reduced dampening for the desired portion of the initial movement of the lid 24 toward its open position.

As with the other dimensions of the housing 200A and the lip seal 210A, 400, the configuration and length of the zone 460 can be adjusted to provide the desired dampening characteristics.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The following is claimed:

1. A trash can, comprising:

a body comprising an interior space, a base portion, and an upper body portion;

a lid moveably mounted to the body, the lid being moveable between open and closed positions;

a pedal mounted to the body such that the pedal is pivotable between a resting position and an actuated position and at least one rod having first and second ends, the first end functionally connected to the pedal and the second end functionally connected to the lid such that the rod pushes the lid from the closed position to the open position as the pedal is moved from the resting position to the actuated position; and at least one motion damper configured to both dampen the movement of the lid from the open position toward the closed position and to also dampen the movement of the lid from the closed position to the open position, the at least one motion damper comprising a damper housing, a piston, a first flexible one-way seal between the piston and the damper housing and a second flexible one-way seal between the piston and the damper housing, wherein the at least one motion damper is configured to provide a first dampening response against the motion of the lid from the open position toward the closed position and provide a second dampening response against the motion of the lid from the closed position toward the open position, the first dampening response being different from the second dampening response, and wherein the first seal is configured to permit a first one-way valve between the piston and the damper housing so as to allow air to pass through the first one-way valve in a first direction and to resist the movement of air through the first one-way valve in a second opposite direction, and the second seal is configured to permit a second one-way valve between the piston and the damper housing so as to allow air to pass through the second one-way valve in the second direction and to resist the movement of air through the second one-way valve in the first direction.

2. The trash can according to claim 1, wherein the at least one motion damper is configured to provide the first dampening response over a first range of motion of the lid from the open position toward the closed position and provide the second dampening response over a second range of motion of the lid from the closed position toward the open position, the second range of motion being smaller than the first range of motion.

3. The trash can according to claim 1, further comprising a linkage assembly extending between the pedal and the lid so as to transfer the motion of the pedal from the resting position to the actuated position to the lid so as to move the lid from the closed position to the open position as the pedal is moved from the resting position to the actuated position.

4. The trash can according to claim 1, wherein the damper housing comprises a first diameter corresponding to a first range of movement of the piston within the damper housing and a second larger diameter corresponding to a second range of movement within the damper housing, the at least one motion damper being connected to the lid such that at least one of the first and second seals moves into contact with the second larger diameter during a movement of the lid between the open and closed positions.

5. The trash can according to claim 1, wherein the piston includes at least one metering channel configured to allow air to leak past at least one of the first and second seals.

6. A trash can, comprising:

a body comprising an interior space, a base portion, and an upper body portion;

a lid moveably mounted to the body, the lid being moveable between open and closed positions;

a pedal mounted to the body such that the pedal is pivotable between a resting position and an actuated position and at least one rod having first and second ends, the first end functionally connected to the pedal and the second end functionally connected to the lid such that the rod pushes the lid from the closed position to the open position as the pedal is moved from the resting position to the actuated position; and at least one motion damper configured to both dampen the movement of the lid from the open position toward the closed position and to also dampen the movement of the lid from the closed position to the open position, the at least one motion damper comprising a damper housing, a piston, a first flexible one-way seal between the piston and the damper housing and a second flexible one-way seal between the piston and the damper housing, wherein the at least one motion damper is configured to provide a first dampening response against the motion of the lid from the open position toward the closed position and provide a second dampening response against the motion of the lid from the closed position toward the open position, the first dampening response being different from the second dampening response, and wherein the damper housing comprises a first diameter corresponding to a first range of movement of the piston within the damper housing and a second larger diameter corresponding to a second range of movement within the damper housing, the at least one motion damper being connected to the lid such that at least one of the first and second seals moves into contact with the second larger diameter during a movement of the lid between the open and closed positions.

7. The trash can according to claim 6, wherein the at least one motion damper is configured to provide the first dampening response over a first range of motion of the lid from the open position toward the closed position and provide the second dampening response over a second range of motion of the lid from the closed position toward the open position, the second range of motion being smaller than the first range of motion.

8. The trash can according to claim 6, further comprising a linkage assembly extending between the pedal and the lid so as to transfer the motion of the pedal from the resting position to the actuated position to the lid so as to move the lid from the closed position to the open position as the pedal is moved from the resting position to the actuated position.

9. The trash can according to claim 6, wherein the piston includes at least one metering channel configured to allow air to leak past at least one of the first and second seals.

* * * * *